US007607939B2

(12) United States Patent
Moriyama et al.

(10) Patent No.: US 7,607,939 B2
(45) Date of Patent: Oct. 27, 2009

(54) CONNECTOR SOCKET MODULE AND ELECTRONIC DEVICE USING THE SAME

(75) Inventors: Satoshi Moriyama, Shinagawa (JP); Mitsuru Kobayashi, Shinagawa (JP); Takeshi Okuyama, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 12/068,356

(22) Filed: Feb. 5, 2008

(65) Prior Publication Data

US 2008/0242145 A1 Oct. 2, 2008

(30) Foreign Application Priority Data

Mar. 29, 2007 (JP) ..... 2007-088778
Aug. 9, 2007 (JP) ..... 2007-208421

(51) Int. Cl.
*H01R 13/73* (2006.01)

(52) U.S. Cl. ..... 439/541.5; 439/620.16

(58) Field of Classification Search ..... 439/541.5, 439/540.1, 620.16
See application file for complete search history.

(56) References Cited

U.S. PATENT DOCUMENTS 4,878,856 A * 11/1989 Maxwell ..... 439/541.5
5,085,590 A * 2/1992 Galloway ..... 439/95
6,643,143 B1 * 11/2003 Stewart et al. ..... 361/828
7,153,158 B1 * 12/2006 Lee ..... 439/541.5

FOREIGN PATENT DOCUMENTS

JP 9-6479 1/1997

* cited by examiner

*Primary Examiner*—Tho D Ta
*Assistant Examiner*—Travis Chambers
(74) *Attorney, Agent, or Firm*—Staas & Halsey

(57) ABSTRACT

A connector socket module having a reduced height used in a server is disclosed, the connector socket module including plural connector sockets, a relay board having a pattern of wiring electrically connected to the connector sockets provided on a front side of the relay board, a relay connector provided on a rear side of the relay board and electrically connected to the connector socket through the wiring, and a main board supporting unit extending from the rear side of relay board and supporting a main board at a prescribed height between upper and lower ends of the relay board, the main board having a main-board-side connector connected to the relay connector.

27 Claims, 20 Drawing Sheets

CONNECTOR SOCKET MODULE AND ELECTRONIC DEVICE USING THE SAME

BACKGROUND OF THE INVENTION

1. Field of the Invention

The present invention generally relates to a connector socket module and an electronic device using the same, and more particularly to a connector socket module and an electronic device using the same that are housed in, for example, a server and a router.

It is desirable that a server and a router have a structure to be easily designed, assembled, and maintained.

2. Description of the Related Art

FIGS. 1 and 2 are diagrams showing part of a conventional server 10. The server 10 usually includes plural I/O (Input/Output) connector sockets. As shown in FIGS. 1 and 2, the server 10 includes two main boards 20 and 21 housed in a chassis panel 11. The I/O connector sockets 30 and 31 at the end of the main boards 20 and 21, respectively, are arranged in two rows, each projecting through a respective opening formed on a front panel 12 of the chassis panel 11.

The server 10 is used where a separate cable-side connector plug 40 at an end of a cable 39 is connected to each of the I/O connector sockets 30 and 31.

Reference may be made to Japanese Patent Application Publication No. H09-006479 for the above-described technique.

In the conventional server 10, however, two separate main boards 20 and 21 are required because the I/O connector sockets 30 and 31 are separately arranged in two rows. Unfortunately, this configuration requires two separate control circuits as well to control each of the two main boards 20 and 21, thus making design and assembly of the server more difficult.

To solve the problems, the applicants of the present invention has proposed a connector socket module in Japanese Patent Application No. 2006-125774.

FIG. 3 is a drawing showing the connector socket module 50 along with a corresponding part of a main board 70 as an exploded drawing of a connector socket module apparatus 80. In the accompanying drawings, X1(right side)-X2(left side) direction indicates a width direction; Y1(rear)-Y2(front) direction indicates a depth direction; and Z1(top)-Z2(bottom) direction indicates a height direction of the connector socket module, respectively.

FIGS. 4 and 5 show where the connector socket module apparatus 80 is housed in a chassis panel 11A of a server 10A. The chassis panel 11A includes a front panel 12A, a bottom panel 13A, and a top panel 14A. The front panel 12A has openings each corresponding to one of the connector sockets 52-1 through 52-4 that are described below.

The connector socket module apparatus 80 is housed in the chassis 11A of the server 10A. The connector socket module apparatus 80 includes a connector socket module 50 and a main board apparatus 70. The connector socket module 50 includes a connector socket module main body 51 and a frame member 60.

The connector socket module main body 51 includes a relay board 53 and four connector sockets 52-1 through 52-4. The connector sockets 52-1 through 52-4 are provided on the front side of the relay board 53 and arranged so that each connector socket is disposed at one of the intersections of a 2 by 2 matrix having a first row HL1, a second row HL2, a first column VL1, and a second column VL2. The distance between the first row HL1 and the second row HL2 is denoted as P1, and the distance between the first column VL1 and the second column VL2 is denoted as P2. A relay connector 54 is provided on the rear side of the relay board 53. As shown in FIG. 3, the relay board 53 of the connector socket module main body 51 is fixed in place to the metal-made frame member 60 with a screw member 55. A relay connector 54 has its connection part 54*a* facing in the Z2 (bottom) direction.

The main board apparatus 70 includes a main board 75 and a main-board-side connector 71 mounted on the main board 75. The main-board-side connector 71 has its connection part 71*a* facing in the Z1(top) direction.

In the connector socket module apparatus 80, as shown in FIGS. 3 though 5, the main-board-side connector 71 is connected to the relay connector 54, and the main board 75 is fixed in place to a bracket part 61 of the frame member 60 with a screw 81. Four I/O connector sockets 52-1 through 52-4, each connected to the main board 75, are arranged in two rows. The connecting direction of the main-board-side connector 71 and the relay connector 54 is parallel to the Z1-Z2 direction.

As shown in FIGS. 4 and 5, the connector socket module apparatus 80 housed in the chassis panel 11A is fixed to the chassis panel 11A with a screw. The connector socket module 50 is fixed in place to a rear surface of the front panel 12A with screws 90 and 91 inserted from the side of the front panel 12A. The four I/O connector sockets 52-1 through 52-4 are arranged in two rows, each projected through the corresponding opening formed on the front panel 12A. The main board 75 is fixed to a pillar part 92 with a screw 93. The pillar part is fixed to the bottom panel 13A.

According to this structure, since the I/O connector sockets 52-1 through 52-4 arranged in two rows are connected to one main board 75, it is possible to reduce the number of the main boards and easy to design and assemble compared with a case where a single main board is connected to the I/O connector sockets arranged in a single row only.

It is desirable that the height H1 of the server 10A be reduced so as to, for example, facilitate the installation of the server 10A.

However, when relational positions are observed between the main board 75 and the relay board 53 in the connector socket module apparatus 80, as shown in FIG. 5, the main board 75 is positioned below the low end of the relay board 53. In addition, a header of the screw 81 is projected from the bottom surface of the main board 75. Therefore, the height Al of the connector socket module apparatus 80 equals the sum of height B1 of the relay board 53, board thickness C1 of the main board 75, and height D1 of a header of the screw 81 (B1+C1+D1); and it is difficult to reduce the height A1.

SUMMARY OF THE INVENTION

The present invention is made in light of the above problems. A connector socket module and an electronic device using the same according to an embodiment of the present invention may solve or reduce one or more of the problems.

According to one aspect of the present invention, there is provided a connector socket module including plural connector sockets, a relay board having a pattern of wiring electrically connected to the connector sockets provided on a front side of the relay board a relay connector provided on a rear side of the relay board and electrically connected to the connector socket through the pattern of wiring, and a main board supporting unit extending from the rear side of relay board and supporting a main board at a prescribed height position between an upper and a lower ends of the relay board, the main board having a main-board-side connector connected to the relay connector.

According to another aspect of the present invention, an arm member is provided as the main board supporting unit, the arm member including a first arm part engaged with a lower side of the relay board and projected from the rear side of the relay board and supporting the main board, and the main board is supported on the first arm part and fixed to the first arm part.

According to still another aspect of the present invention, the first arm part includes a supporting part at a top end of the first arm part and supports the main board on the top end of the first arm part, and the supporting part is located higher than a base end of the first arm part.

According to still another aspect of the present invention, the relay board includes a cut-out part on a lower side of the relay board, and the arm member engages the cut-out part.

According to still another aspect of the present invention, the relay connector has a connecting part facing the back side of relay board.

According to still another aspect of the present invention, the connector socket module further includes a frame member including a main body part supporting a main body of the connector socket module, a protruding part extending through a corner of the relay board to the front side of the relay board and coming into contact with the chassis panel.

According to still another aspect of the present invention, the frame member further includes a bracket part to be fixed to the chassis panel.

According to still another aspect of the present invention, the arm member further includes a second arm part extending to the front side of the relay board and coming into contact with the chassis panel.

According to still another aspect of the present invention, the main-board-side connector is disposed below the main board, the main board supporting unit includes a frame to be fixed to the rear side of the relay board, and an arm member, fixed to the frame, supporting the main board from the lower side of the main board, the arm member being disposed so as not to come into contact with the main-board-side connector and the relay connector connected to the main-board-side connector.

According to still another aspect of the present invention, the arm member includes a pair of arm parts supporting the main board, the arm parts being provided on both end sides of the arm member in the width direction when viewed from above.

According to still another aspect of the present invention, there is provided an electronic device including a connector socket module according to claim 1, a main board supported by the main board supporting unit, and a chassis panel housing the connector socket module and the main board.

As described above, in the connector socket module including the connector socket module and the main board, the main board is supported by the main board supporting unit so that an end surface of the main board faces the rear surface of the relay board. Because of this structure, the board thickness of the main board is included in the height of the relay board in the connector socket module apparatus. As a result, the height of the connector socket module apparatus is dependent only on the height of the socket connector module, thereby reducing the height of the connector socket module apparatus.

This makes it possible to reduce the height of an electronic device in which the connector socket module apparatus is housed.

DETAILED DESCRIPTION OF THE PREFERRED EMBODIMENTS

Next, a connector socket module and an electronic device using the same according to embodiments of the present invention are described below with reference to the accompanying drawings.

Example 1

Figure 6:
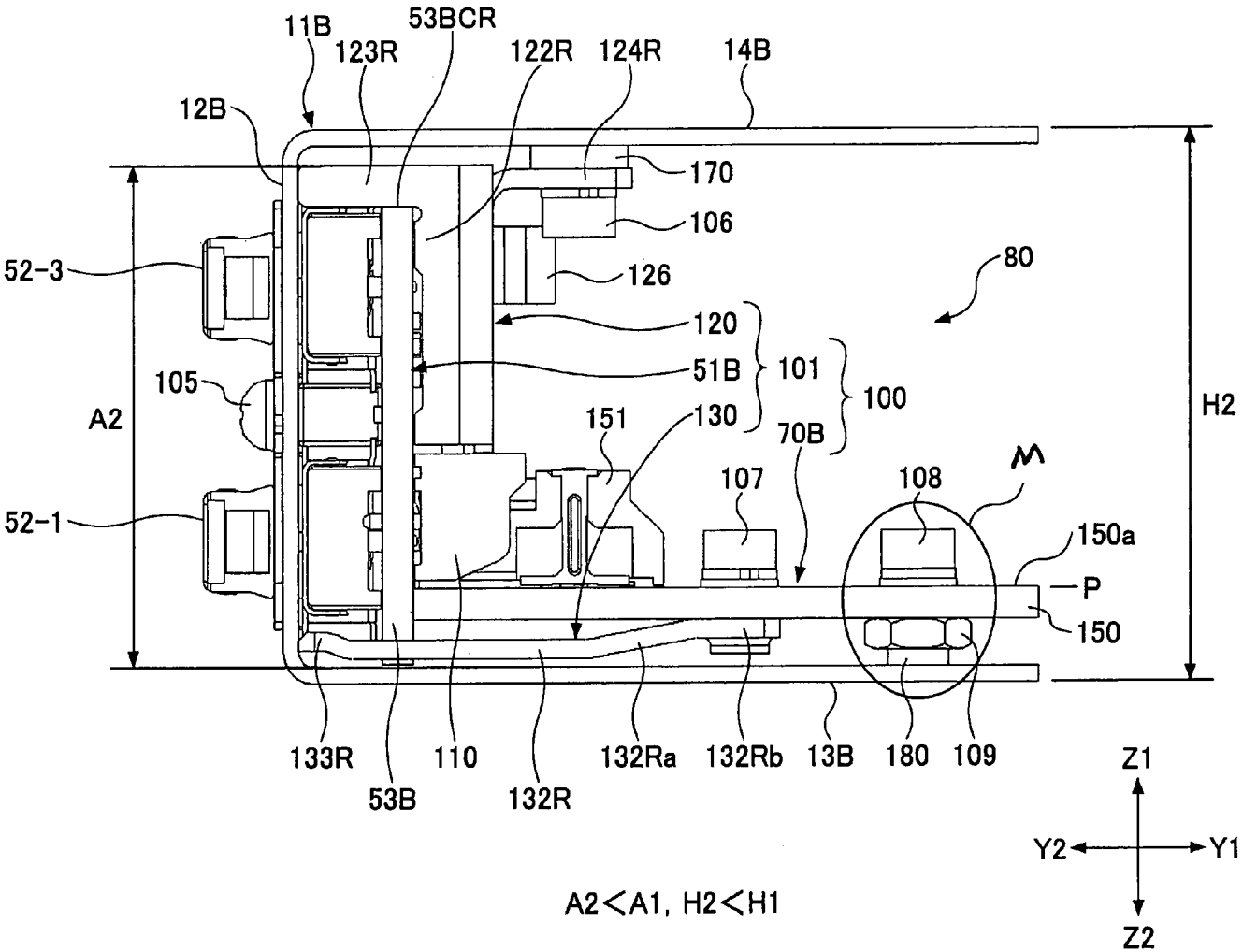
FIG. 6 is a side view of a server according to example 1 of the present invention.
Figure 7:
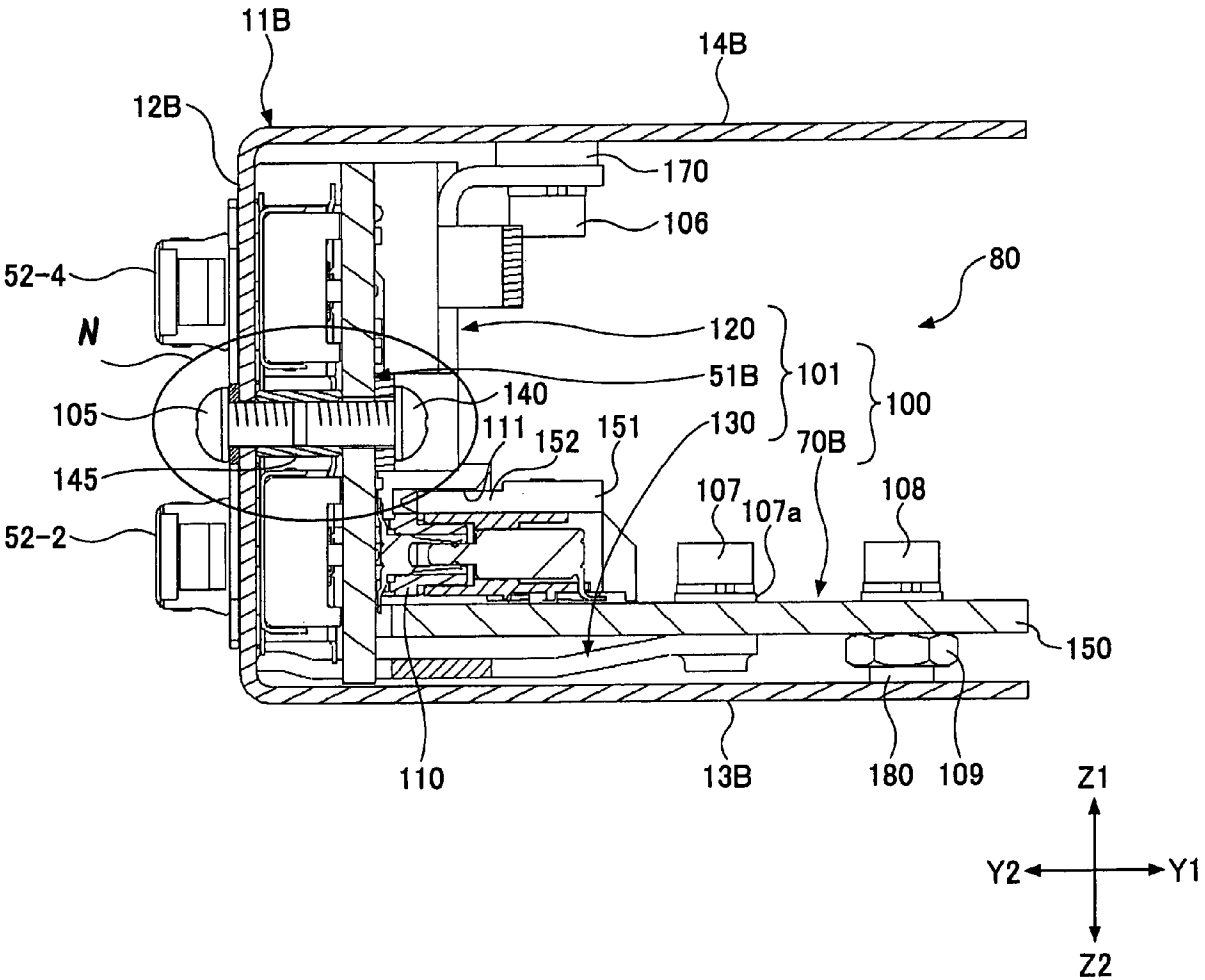
FIG. 7 is a cut-open side view of the server in FIG. 6.
Figure 8:
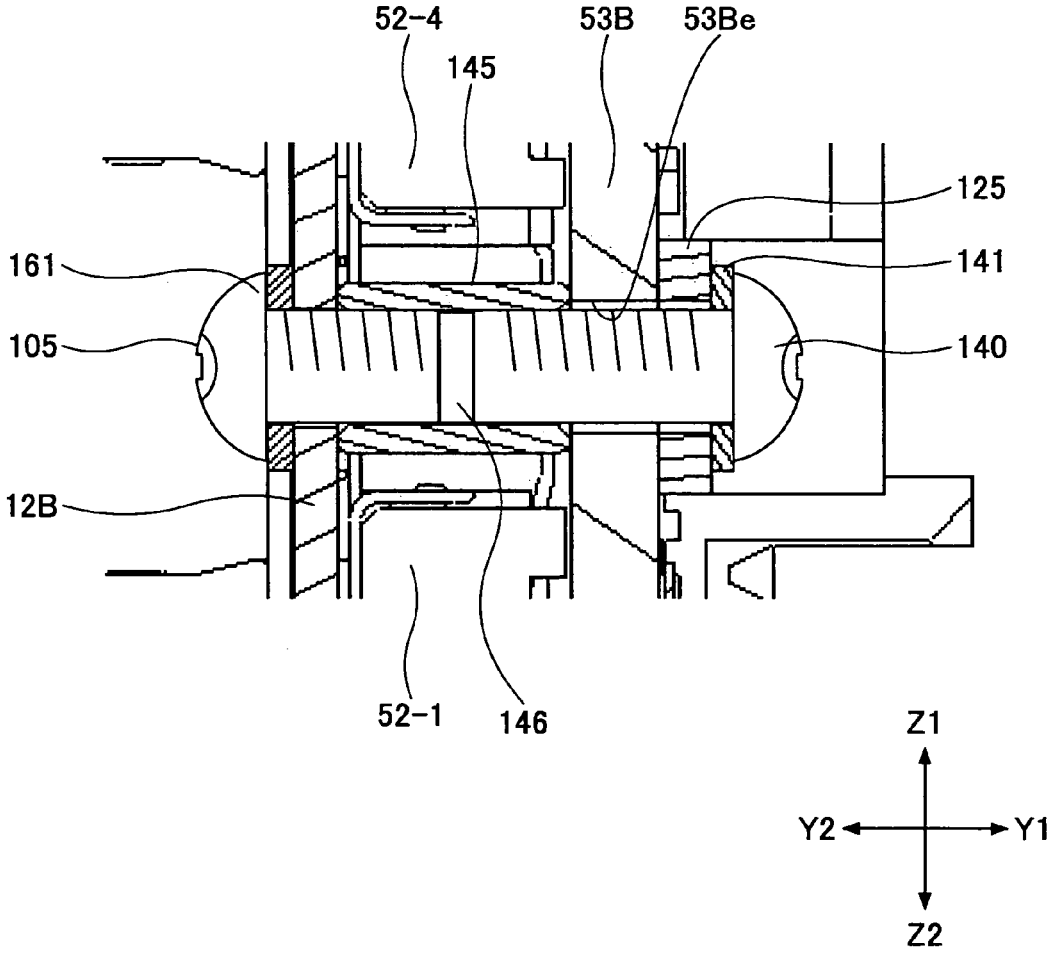
FIG. 8 is a expanded view corresponding with the ellipse (N) in FIG. 7.
Figure 9:
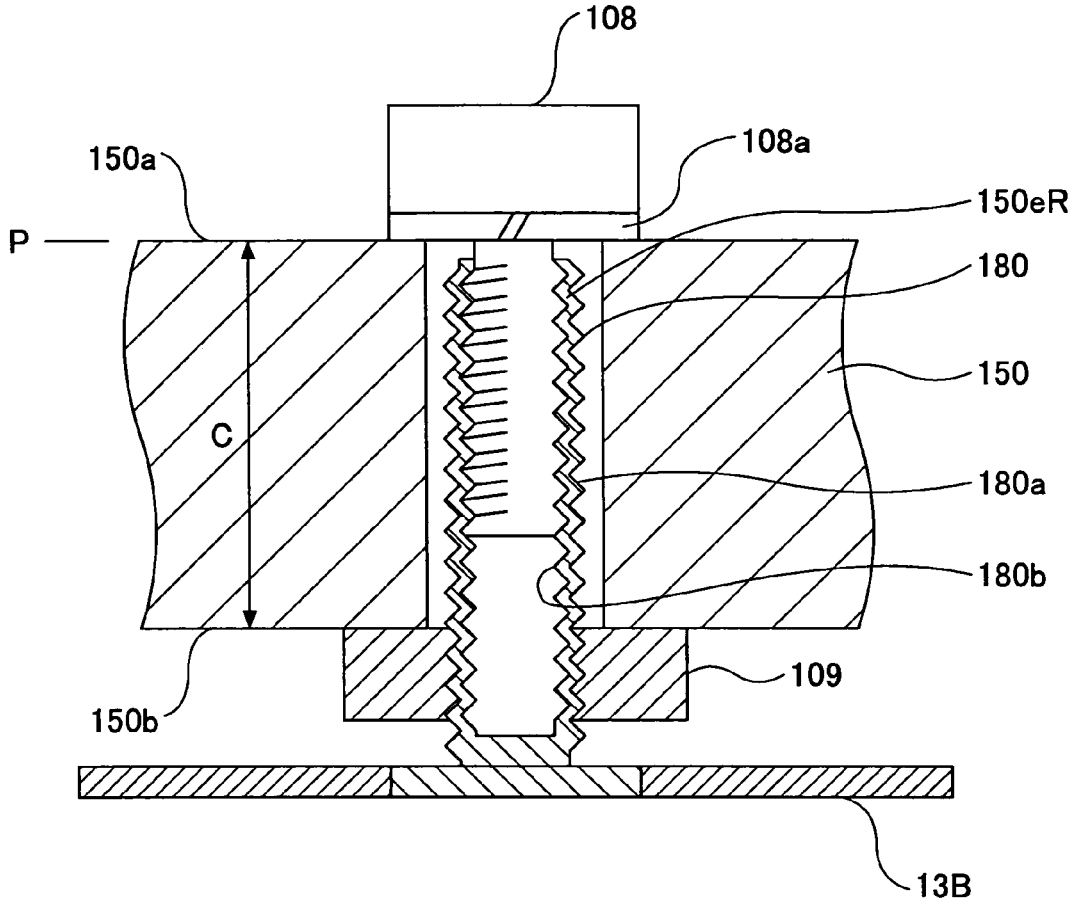
FIG. 9 is a expanded view corresponding with the ellipse (M) in FIG. 6.

FIGS. 6 through 9 are drawings showing the entire or part of a server 10B. More specifically, FIG. 6 shows the server 10B housing a connector socket module apparatus 100 according to example one of the present invention. FIG. 7 is a cut-open side view of the server 10B in FIG. 6. FIG. 8 is an expanded view showing part of the server 10B in FIG. 7. FIG. 9 is an expanded cut-open side view of part of the server 10B in FIG. 6.

Figure 10:
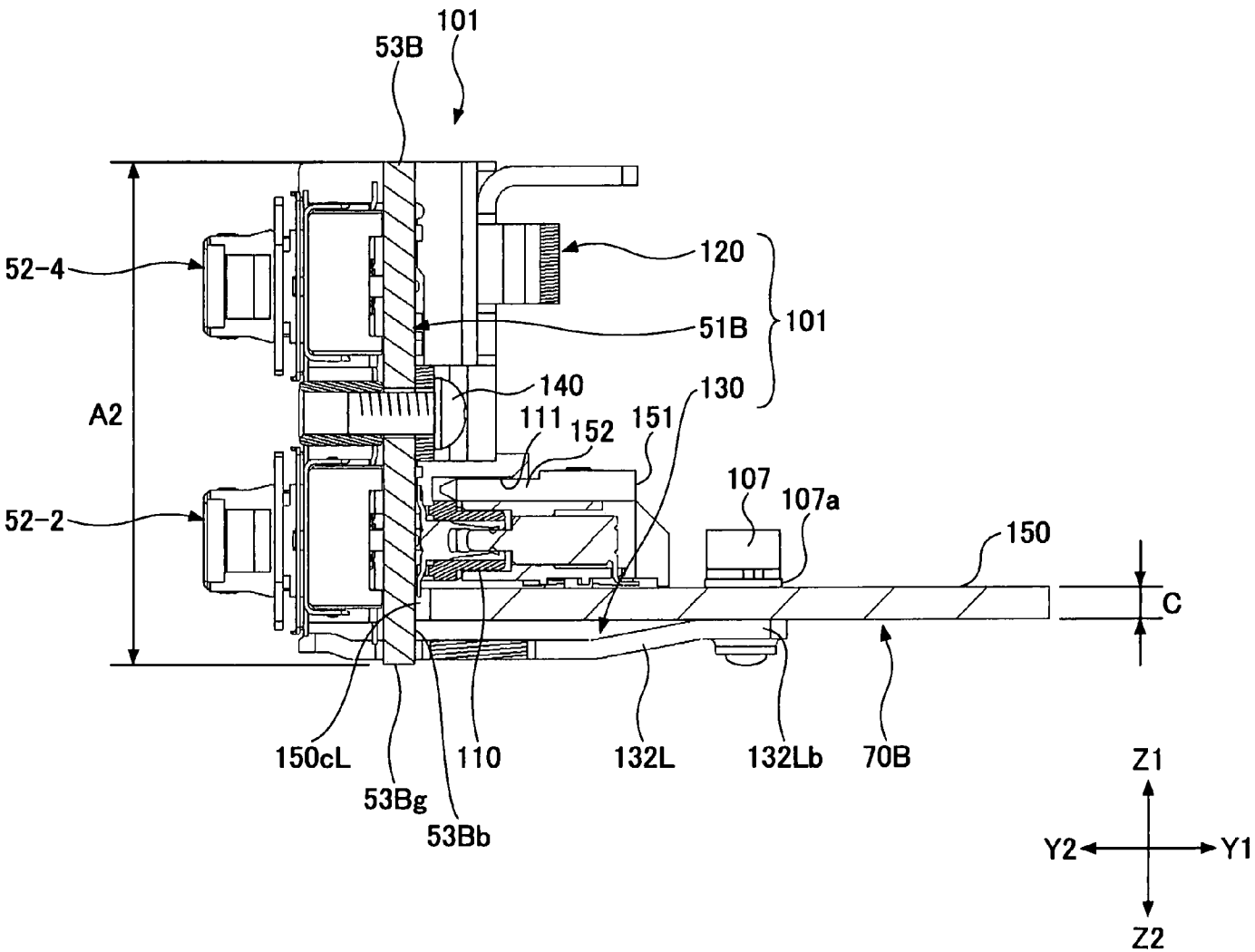
FIG. 10 is a cut-open side view of a connector socket module apparatus according to a first embodiment of the present invention.
Figure 11:
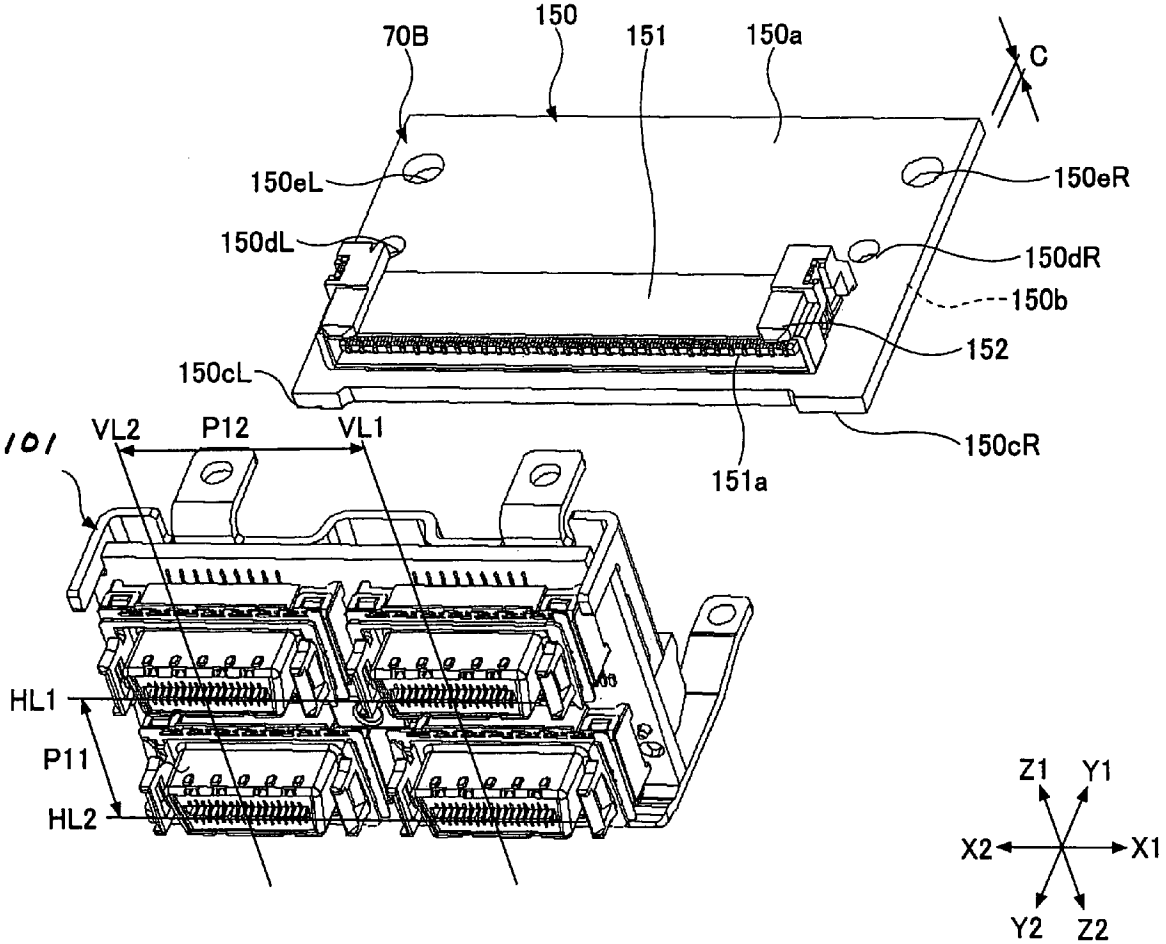
FIG. 11 is an exploded perspective view of the connector socket module apparatus of FIG. 10 when viewed from the upper front side.
Figure 12:
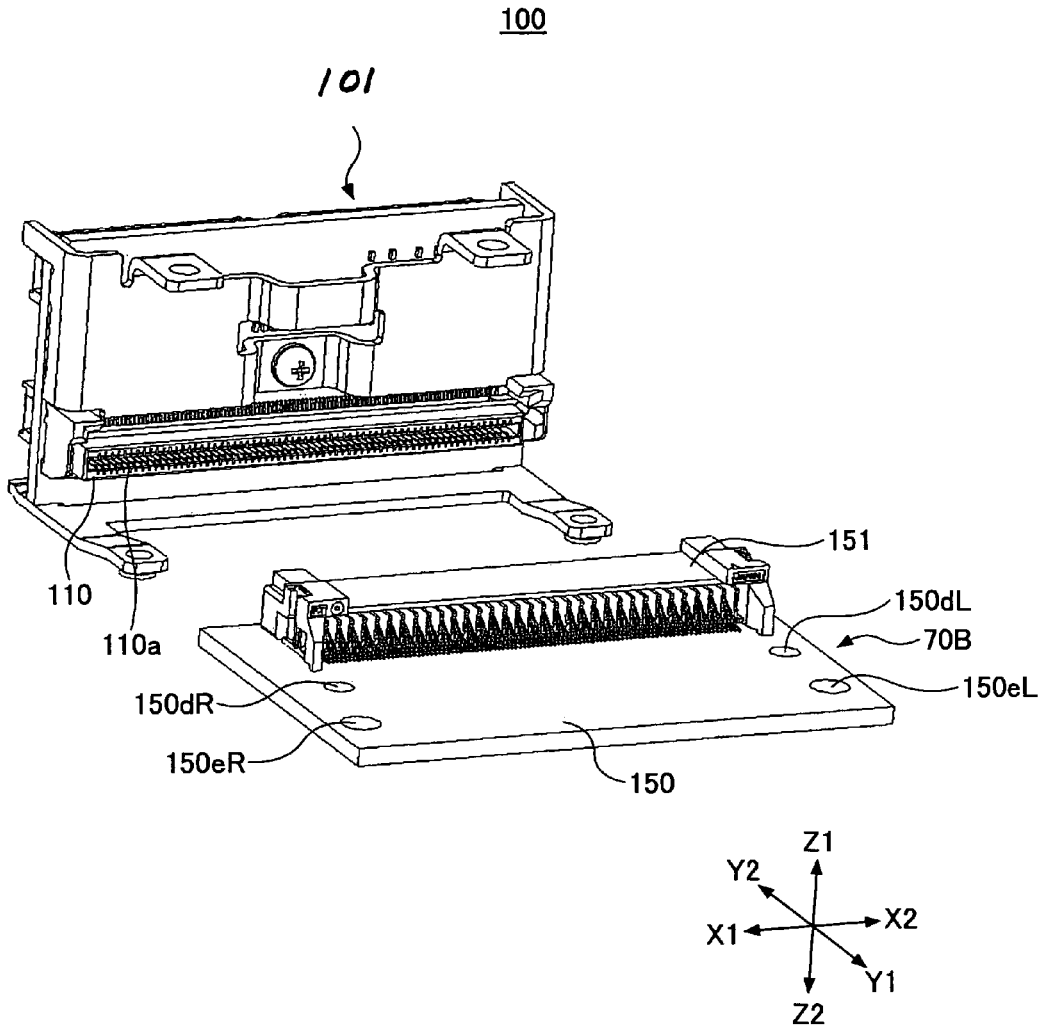
FIG. 12 is an exploded perspective view of the connector socket module apparatus in FIG. 10 when viewed from the rear side.

FIGS. 10 through 12 show the connector socket module apparatus 100. More specifically, FIG. 10 shows the entire connector socket module apparatus 100. FIGS. 11 and 12 are exploded views of the connector socket module apparatus 100 including a connector socket module 101 and a corresponding part of a main board 70B when viewed from the front and the rear sides, respectively.

FIGS. 13 through 16 show the connector socket module 101. More specifically, FIGS. 13, 14, 15, and 16 are a perspective view, a plan view, a cut-open side view, and an exploded view, respectively, of the connector socket module 101.

Figure 3:
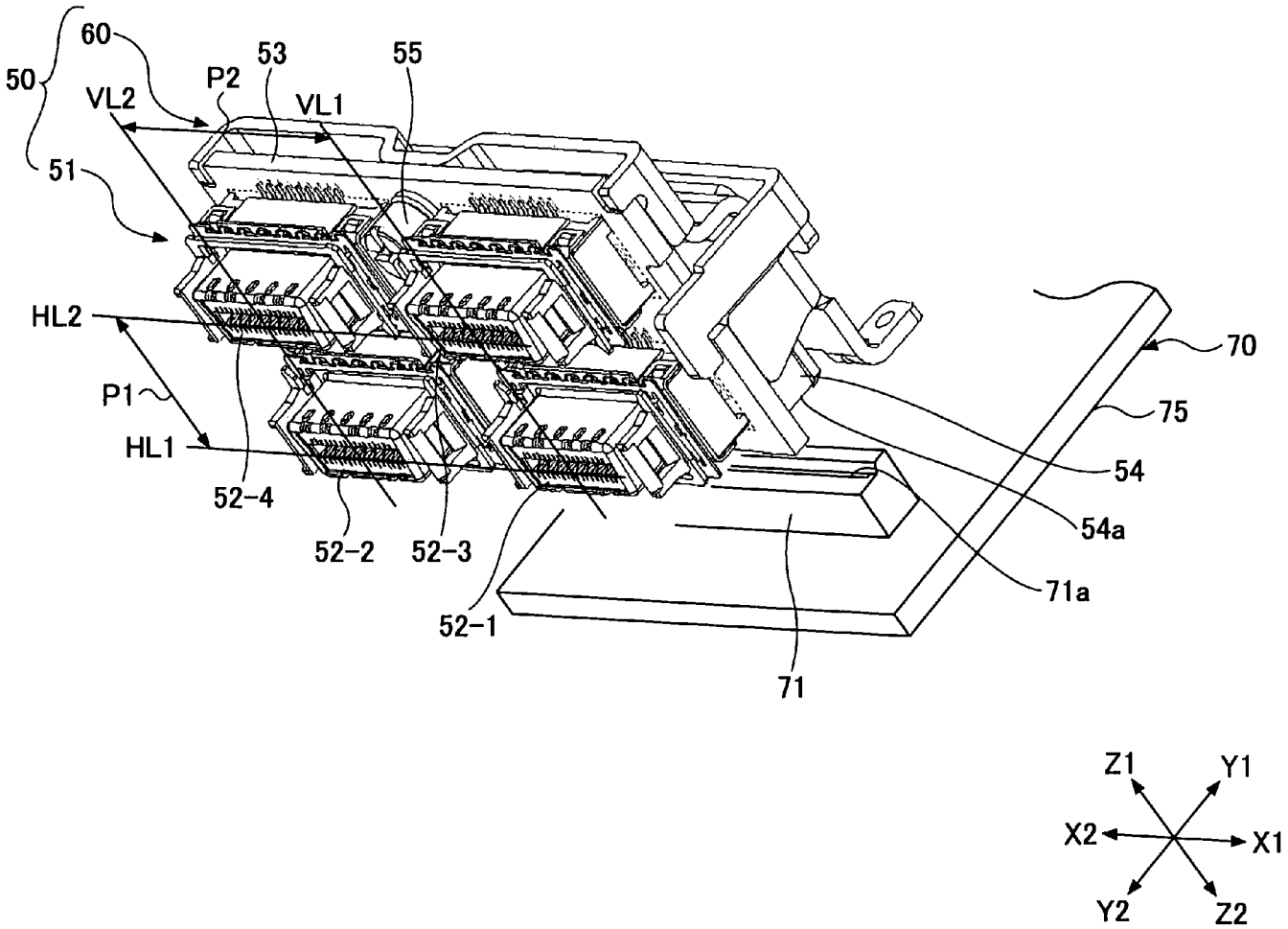
FIG.3 PRIOR ART
FIG. 3 is a perspective view showing a contact socket module and a corresponding part of a main board according to one embodiment of a patent that applicants of the present invention have previously applied.
Figure 4:
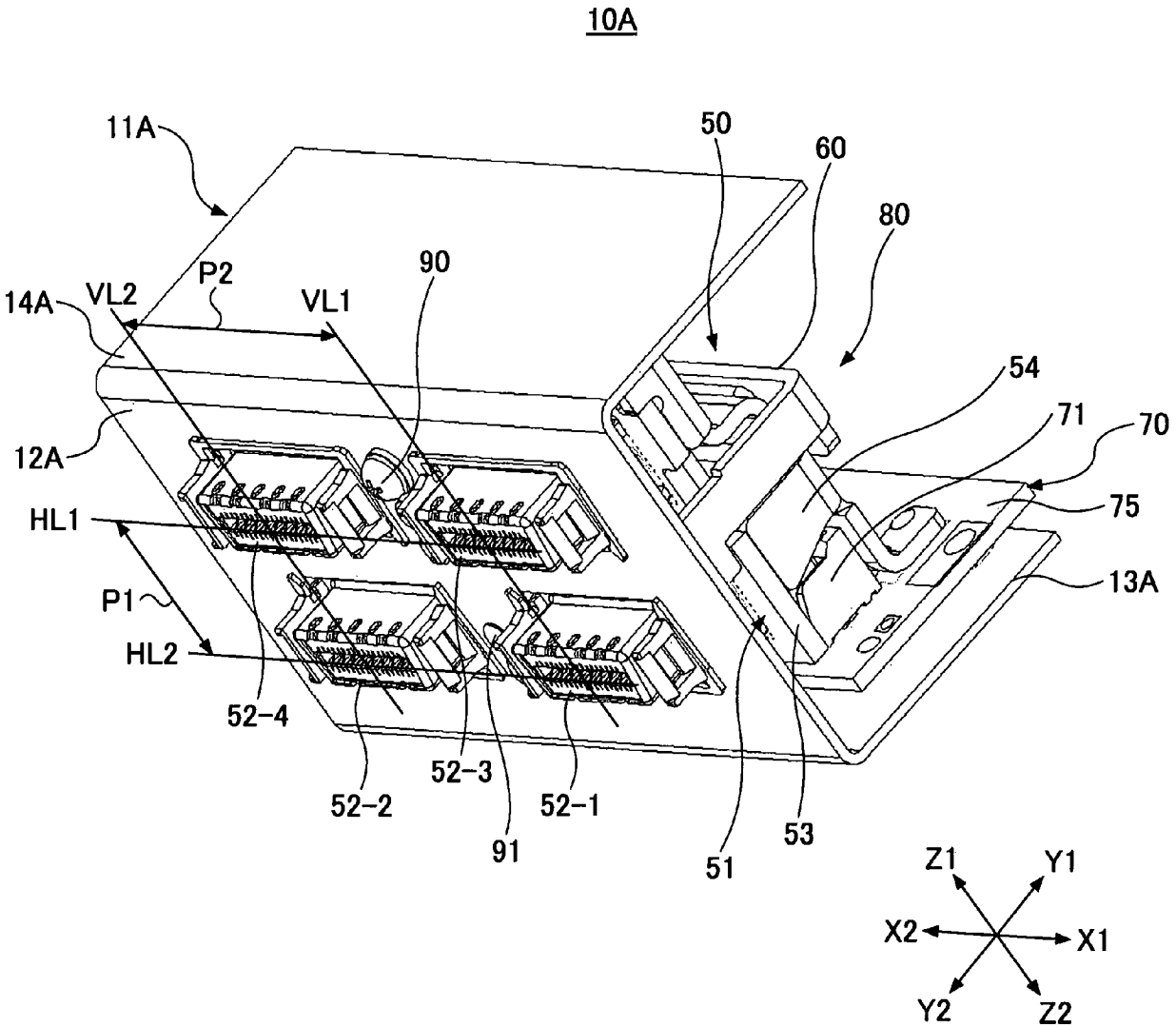
FIG.4 PRIOR ART
FIG. 4 is a perspective view showing where part of a server in which the connector socket module and the main board shown in FIG. 3 are housed in a chassis panel.
Figure 5:
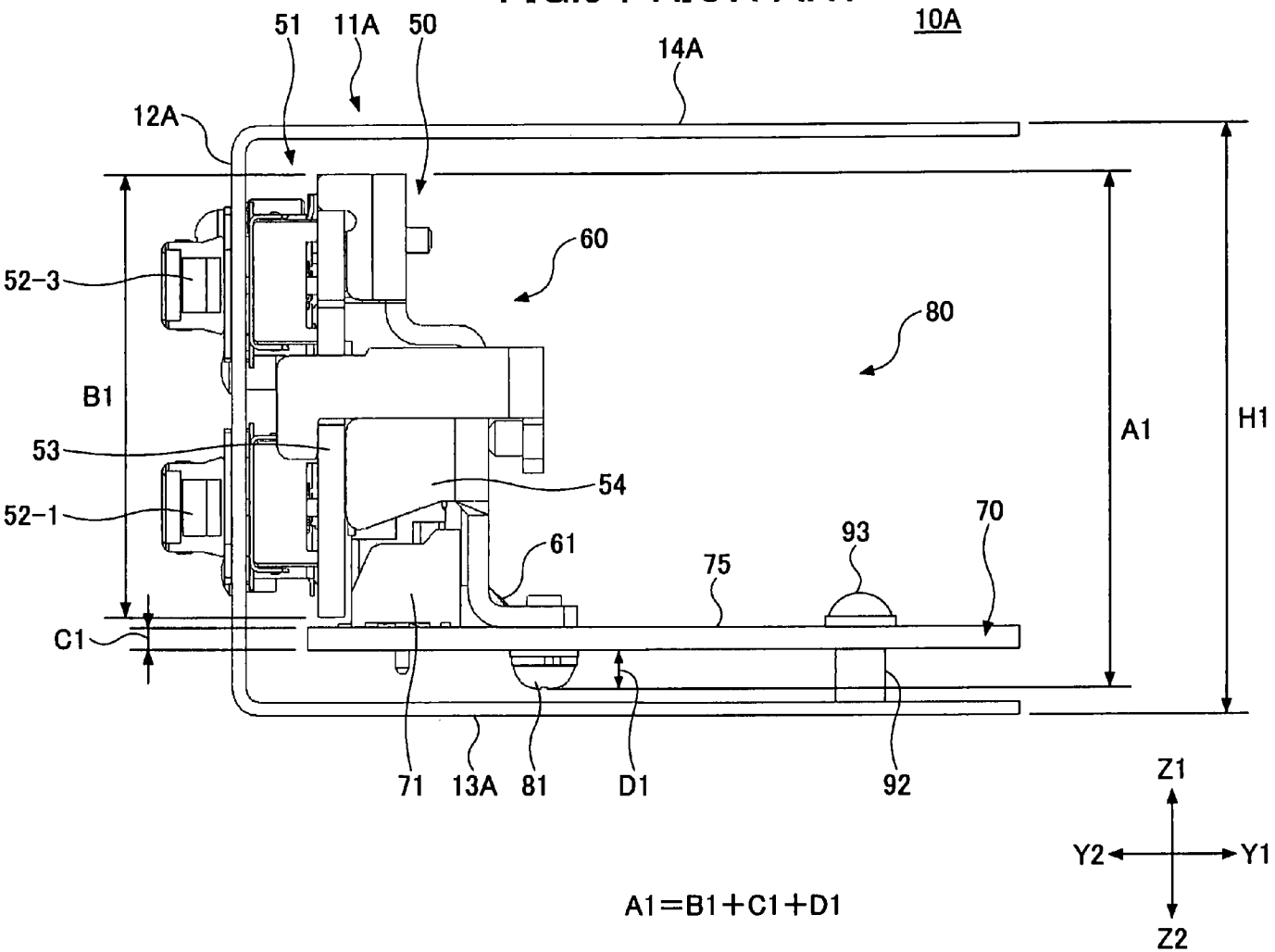
FIG.5 PRIOR ART
FIG. 5 is a side view of the server of FIG.4.

In those drawings, the same reference numerals followed with an additional letter "B" are used to identify substantially the same elements in FIGS. 3 through 5. Further, X1(right side)-X2(left side) direction indicates a width direction, Y1(rear)-Y2(front) direction indicates a depth direction, and Z1(top)-Z2(bottom) direction indicates a height direction, respectively, of the connector socket module apparatus 100 and the connector socket module 101.

[Overall General Configuration]

The server 10B includes a chassis panel 11B and the connector socket module apparatus 100 housed in the chassis panel 11B. The height A2 of the connector socket module apparatus 100 shown in FIG. 6 is less than the height A1 of the connector socket module apparatus 80 shown in FIG. 5. The height H2 of the server 10B, that is, the height H2 of the chassis panel 11B in FIG. 6 is less than the height H1 of the server 10A shown in FIG. 5.

Figure 1:
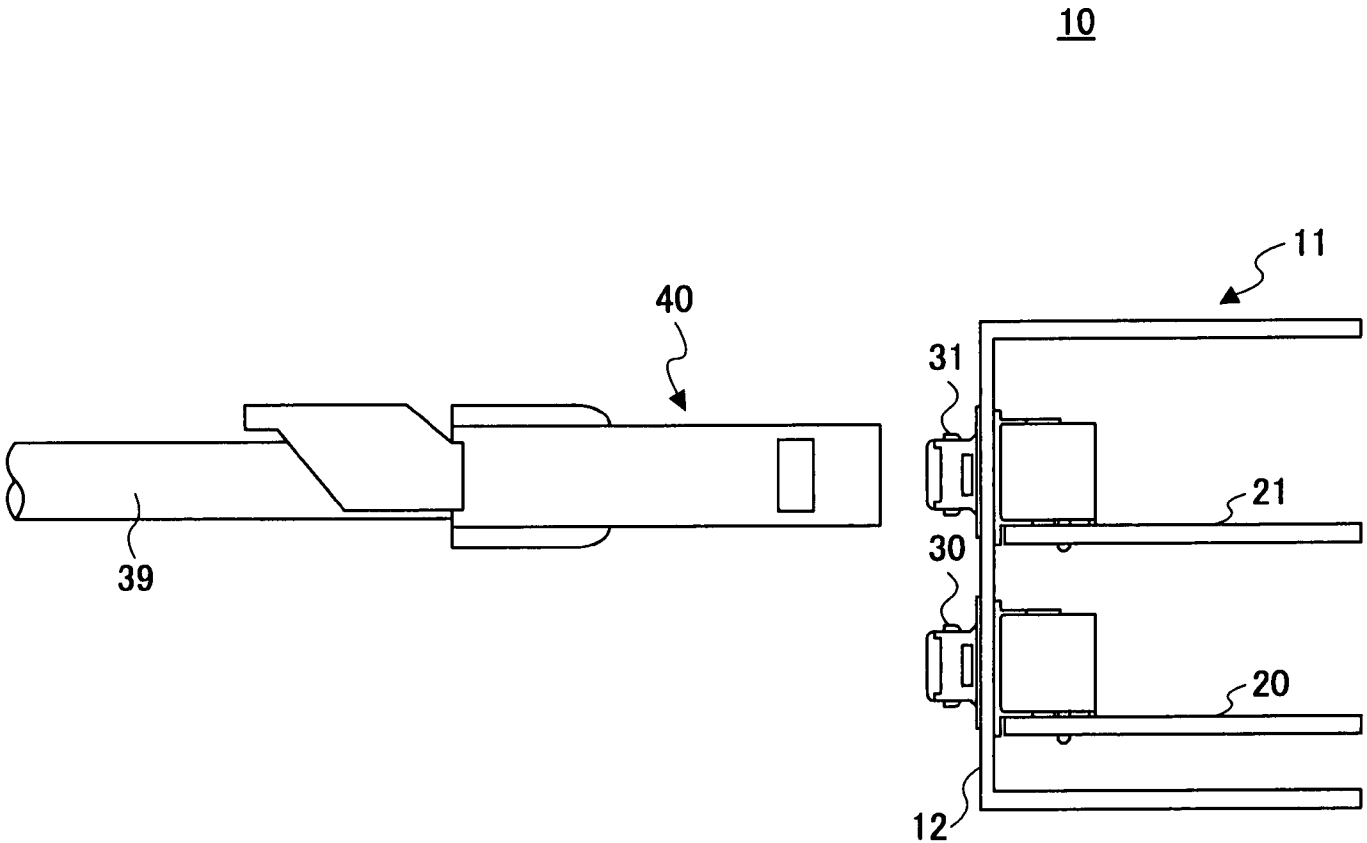
FIG.1 PRIOR ART
FIG. 1 is a view showing part of a conventional server.
Figure 2:
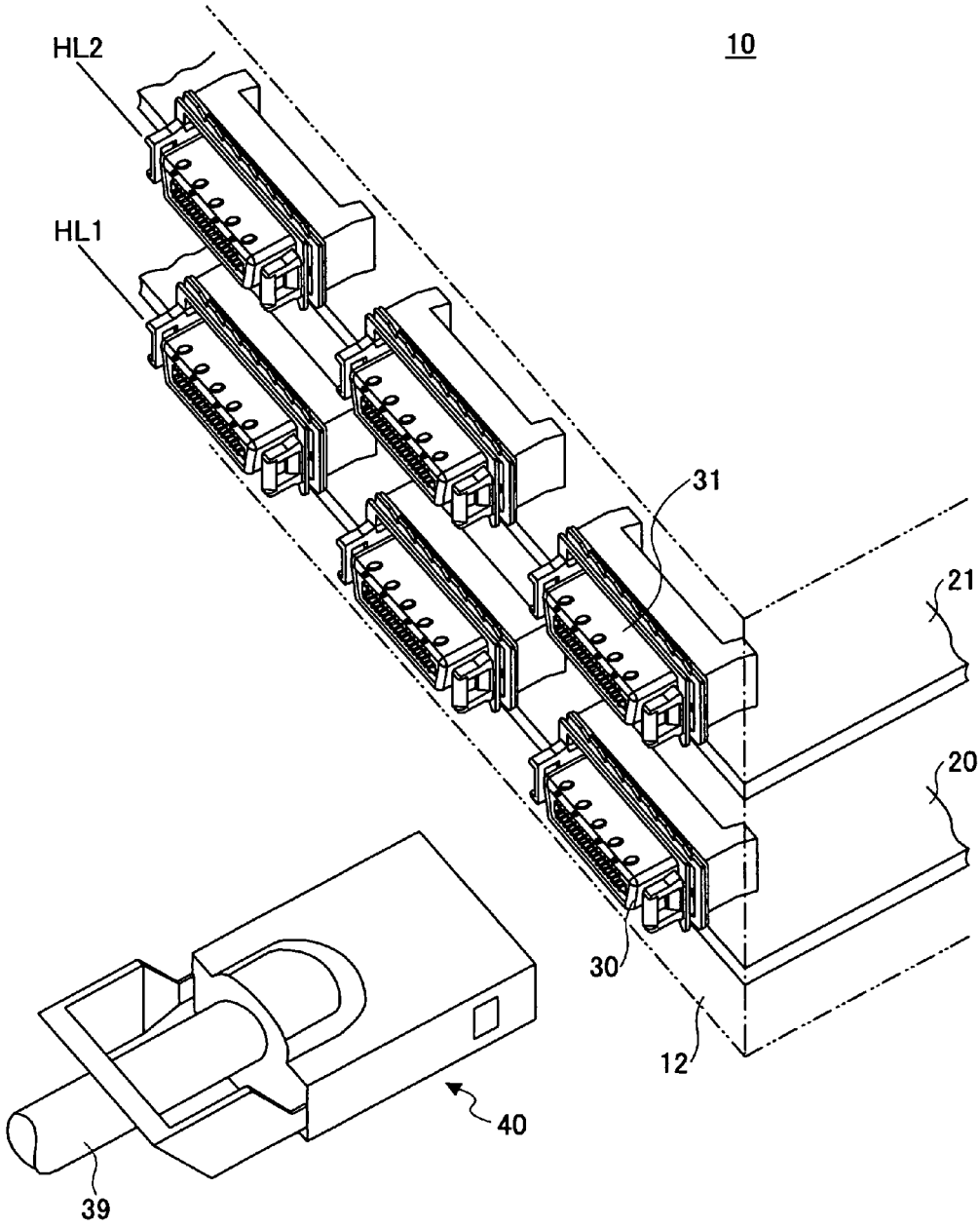
FIG.2 PRIOR ART
FIG. 2 is a perspective view of the server of FIG. 1.

In the server 10B, the connector socket module apparatus 100 includes the connector socket module 101 and a main board apparatus 70B. (see FIGS. 10 through 12) The connector socket module 101 includes a connector socket module main body 51B, a frame member 120, and an arm member 130 (see FIGS. 13 through 15). The server 10B includes plural I/O connector sockets 52-1 through 52-4 arranged in place and projected to the outside chassis panel 11B. Each of the I/O connector sockets 52-1 through 52-4 is provided for connecting to a cable-side connector plug 40 connected to an external electronic device. (see, for example, FIG. 1)

[General Configuration of Connector Socket Module Apparatus 100]

As shown in FIGS. 6, 10, and 11, the connector socket module apparatus 100 includes the connector socket module 101 and the main board apparatus 70B. In the connector socket module apparatus 100, a relay board 53B and a main board 150 are disposed at substantially right angles to each other. As shown in FIG. 10, the height level (in the Z1 side) of the main board 150 is shifted to Z1 side and higher than the height level of an end surface 53Bg on the Z2 side of the relay board 53B. Further, end surface parts 150*c*R and 150*c*L of the main board 150 face and come into contact with a rear surface 53Bb of the relay board 53B. The connecting direction of a main-board-side connector 151 and a relay connector 110 is parallel to the Y1-Y2 direction.

[General Configuration in the Chassis Panel 11B of the Server 10B]

FIG. 6 shows where the connector socket module apparatus 100 is housed in the chassis panel 11B of the server 10B. The chassis panel 11B includes a front panel 12B, a bottom panel 13B, and a top panel 14B. The connector socket module 101 is fixed to the front panel 12B and the top panel 14B with screws 105 and 106, respectively. The main board 150 is fixed to the bottom plate 13B with a screw 108 and a nut 109.

[General Configuration of Connector Socket Module 101]

Figure 14:
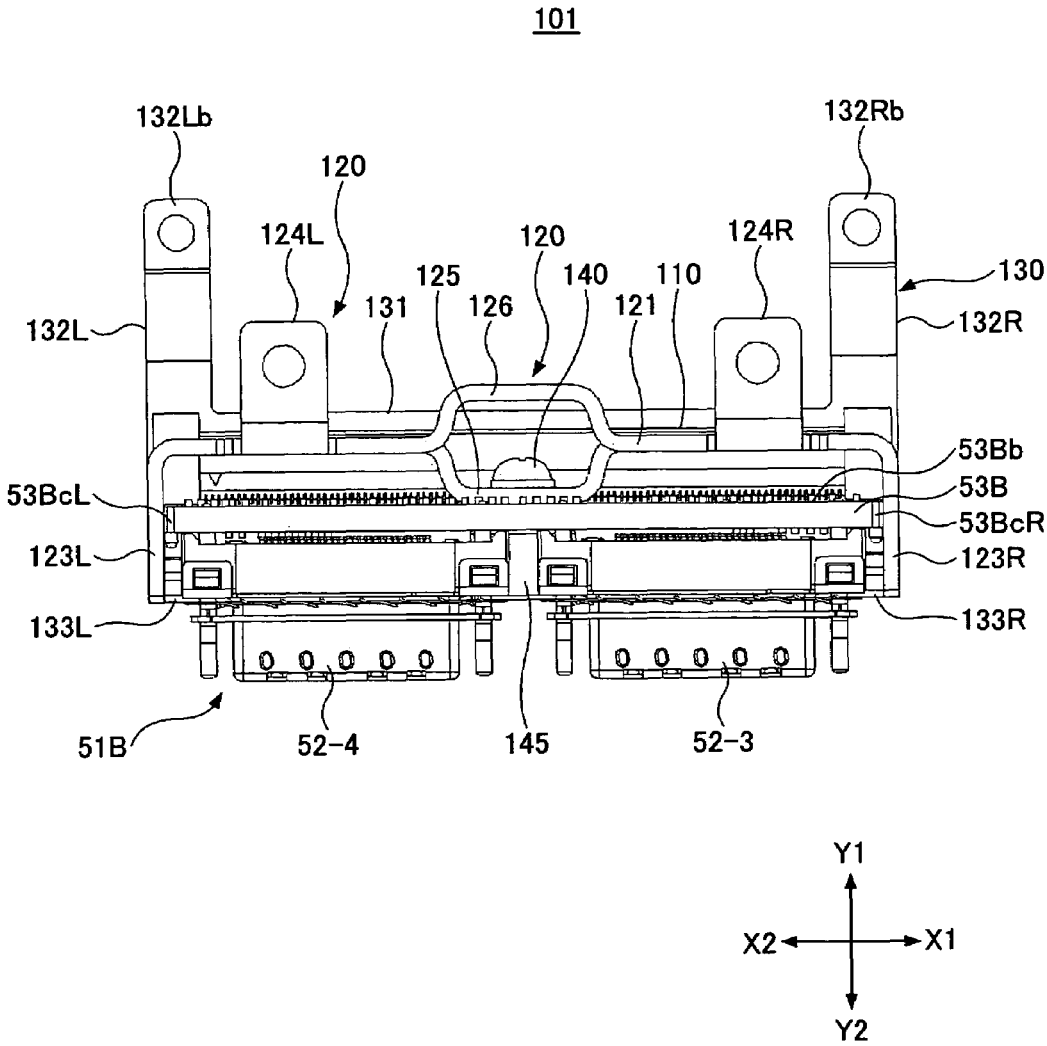
FIG. 14 is a plan view of the connector socket module in FIG. 13.
Figure 15:
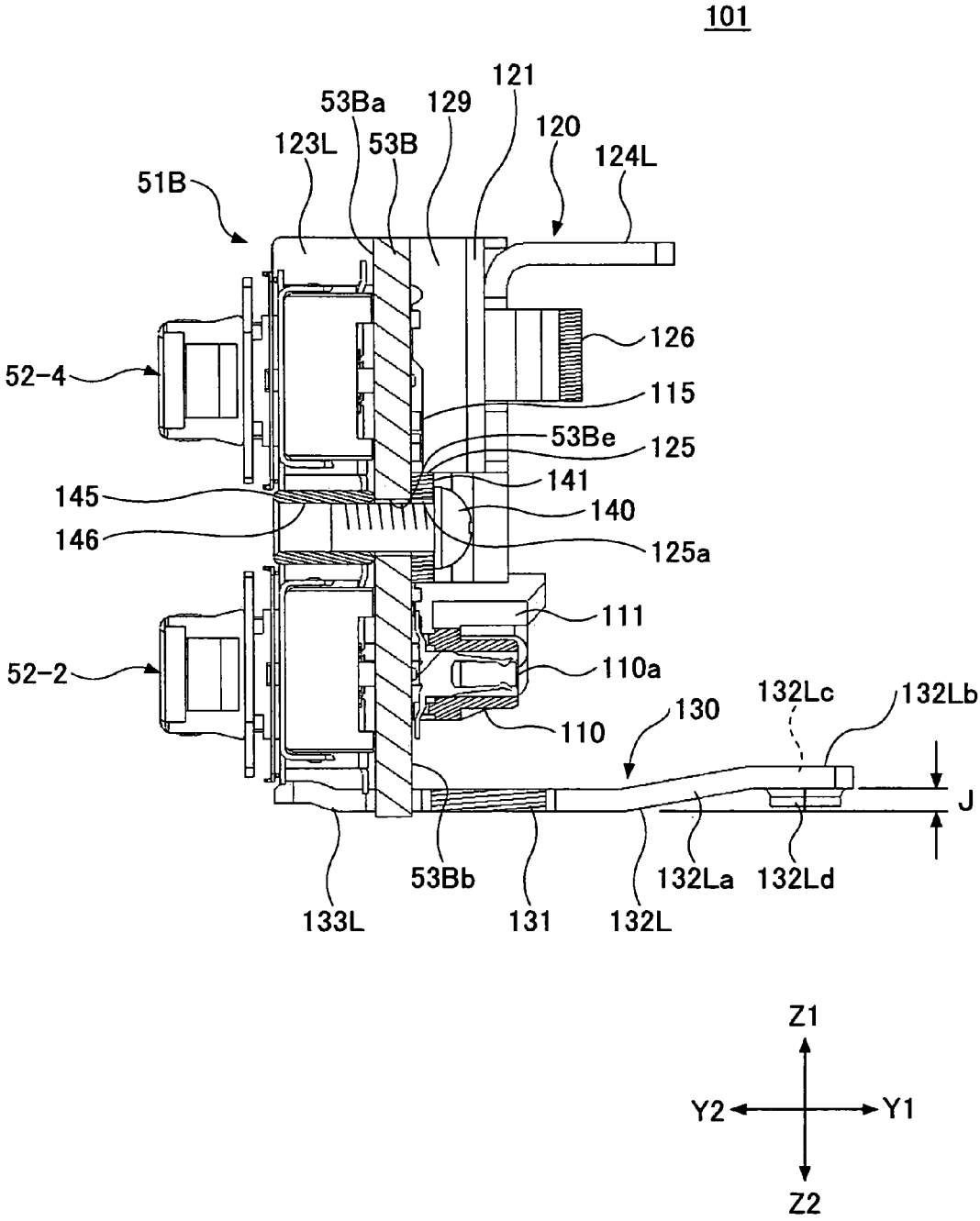
FIG. 15 is a cut-open side view of the connector socket module in FIG. 13.
Figure 16:
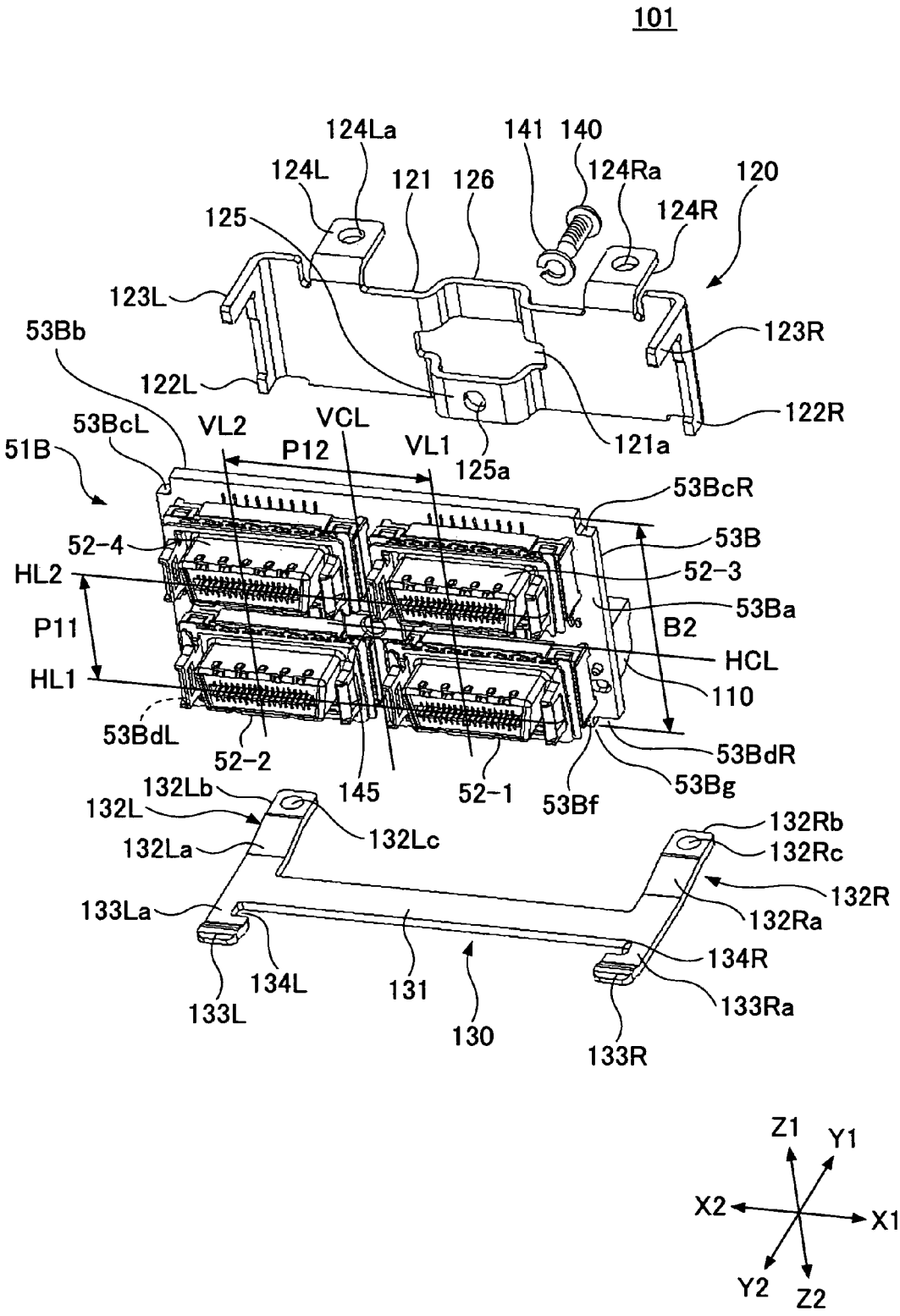
FIG. 16 is an exploded perspective view of the connector socket module in FIG. 13.

As shown in FIGS. 14 through 16, the connector socket module 101 includes the connector module main body 51B, the frame member 120, and the arm member 130, the frame member 120 and the arm member 130 being made of metal.

The connector socket module 101 and the connector socket module main body 51B are substantially bilaterally symmetric with respect to a center line VCL extending in the direction parallel to the Z-axis direction. Reference numerals of elements on the X1 and X2 sides have additional characters R (Right) and L (Left), respectively. Reference symbol HCL denotes a center line of the connector socket module main body 51B, the line being extended in the direction parallel to the X-axis direction.

[Configuration of Connector Socket Module Main Body 51B]

As shown in FIG. 16, the connector socket module main body 51B includes a substantially rectangular-shaped relay board 53B and four I/O connector sockets 52-1 through 52-4 arranged on a front surface 53Ba of the relay board 53B so that one connector socket is disposed at each intersection of a 2 by 2 matrix having a first row HL1, a second row HL2, a first column VL1, and a second column VL2. Further, as shown in FIGS. 12 and 15, a relay connector 110 and plural parts are mounted on a rear surface 53Bb of the relay board 53B. An electrical connection between the terminals of the four I/O connector sockets 52-1 through 52-4 and the terminals of the relay connector 110 are provided by wiring patterns formed in and on a surface of the relay board 53B.

The I/O connector sockets 52-1 through 52-4 shown in FIG. 16 are more compactly arranged than those in FIG. 3. Namely, the distance P11 between HL1 and HL2 shown in FIG. 16 is less than the distance P1 in FIG. 3. Further, the distance P12 between VL1 and VL2 shown in FIG. 16 is less than the distance P2 in FIG. 3 Thus, the height B2 of the relay board 53B in FIG. 16 is less than the height B1 of the relay board 53 in FIG. 5.

As shown in FIGS. 12 and 15, a connection part 110*a* of the relay connector 110 and a positioning slit 111 have openings facing in the Y1 direction.

As shown in FIG. 16, the relay board 53B includes cut-out parts 53BcR and 53BcL formed on the X1 and X2 sides, respectively, at corners in the Z1 direction, cut-out parts 53BdR and 53BdL formed on the X1 and X2 sides, respectively, at corners in the Z2 direction and a through hole 53Be substantially in its center (as shown FIG. 15). Accordingly, the through hole 53Be is positioned substantially in the center of the four connector sockets 52-1 through 52-4 arranged in a matrix manner. As a result of creating the cut-out parts 53BdR and 53BdL, a rim part 53Bf is provided, projecting from the cut-out parts 53BdR and 53BdL in the Z2 direction. An end surface of the rim part 53Bf on the Z2 side is an end surface 53Bg of the relay board 53B.

[Configuration of Frame Member 120]

As seen from FIG. 16, the frame member 120 supports the connector socket module main body 51B and fixes the Z1 side of the connector socket module main body 51B to the chassis panel 11B.

As shown in FIGS. 14 and 16, the frame member 120, made by punching and bending a metal sheet to form its specific figure, includes a main body part 121, side bracket parts 122R and 122L, protruding parts 123R and 123L, and upper (on the Z1 side) bracket parts 124R and 124L, disposed on the right and left sides, respectively.

The main body part 121 includes a prolonged slit 121*a* formed in its center and extending in the direction parallel to the X direction, a fixing plate part 125 formed on the Z2 side of the slit 121*a* and projected toward the Y2 direction in a substantially U-shape, and a hook up part 126 formed on the Z1 side of the slit 121*a* projected toward the Y1 direction in a substantially U-shape.

As shown in FIG. 15, the fixing plate part 125 comes into contact with the rear surface 53Bb of the relay board 53B and has a hole 125*a* formed for receiving a screw. The fixing plate part 125 provides a space 129 between the rear surface 53Bb of the relay board 53B and the main body part 121 to accommodate chip parts 115. The U-shaped hook up part 126 is formed so that the length from the center of the slit 121*a* to the top of the hook up part 126 on the Z1 side is substantially equal to the length from the center of the slit 121*a* to the bottom of the fixing plate part 125 on the Z2 side and provides a larger space in the vicinity of the rear surface 53Bb of the relay board 53B. Further, the U-shaped fixing plate part 125 and the hook up part 126 reinforce rigidity of the frame member 120.

The side bracket parts 122R and 122L are projected from the right and left ends of the main body part 121 in the Y2 direction so as to come into contact with right and left ends, respectively, of the rear surface 53Bb of the relay board 53B.

The protruding parts 123R and 123L are projected in the Y2 direction from parts on the Z1 side of the side bracket parts 122R and 122L and engage the cut-out parts 53BcR and 53BcL, respectively, for positioning the connector socket module main body 51B with respect to the frame member 120. Further, for positioning the connector socket module main body 51B with respect to the chassis panel 11B, the protruding parts 123R and 123L come into contact with parts on the Z1 side of the rear surface of the front panel 12B (see FIG. 6).

The upper bracket parts 124R and 124L are projected from parts close to right and left ends on the Z1 side of the main body part 121 in the Y1 direction, formed in an X-Y plane, and have holes 124Ra and 124La, respectively, and formed so as to be fixed to the top panel 14B with screws.

[Arm Member 130]

As shown in FIG. 10, the arm member 130 supports the Z2 side of the connector socket module main body 51B and holds the main board apparatus 70B so that the height level of the main board apparatus 70B is higher in the Z1 direction than the height level of an end surface on the Z2 side of the relay board 53B. Further, the arm member 130 determines the position of the Z2 side of the connector socket module main body 51B with respect to the front panel 12B.

As shown in FIG. 16, the arm member 130, made by punching and bending a metal sheet to form its specific figure, includes a long main body part 131 prolonged in the X direction, first arm parts 132R and 132L extending in the Y1 direction from right and left ends of the main body part 131, and second arm parts 133R and 133L extending in the Y2 direction from right and left ends of the main body part 131, respectively.

The first arm parts 132R and 132L include slope parts 132Ra and 132La sloped in the Z1 direction and horizontal supporting parts 132Rb and 132Lb formed from ends on the Y1 side of the slope parts 132Ra and 132La, respectively. As shown in FIG. 15, each of the supporting parts 132Rb and 132Lb is disposed at a higher level in the Z1 direction than the level of the main body part 131 by length J. The length J is greater than the sum of height generated in a Burring process and the height of a projection part of a screw described below.

Further, receiving screw parts 132Rc and 132Lc are formed on inner surfaces of Burring processed parts 132Rd and 132Ld and project in the Z2 direction from the supporting parts 132Rb and 132Lb, respectively.

The second arm parts 133R and 133L, extending in the Y2 direction and sloping in the Z1 direction, are projected in substantially the same length as the protruding parts 123R and 123L. The end parts of the second arm parts 133R and 133L come into contact with the rear surface on the Z1 side of the front panel 12B.

Further, as shown in FIG. 16, slits 134R and 134L are provided where the second arm parts 133R and 133L are connected to the main body part 131, respectively. Each of the slits 134R and 134L engages the corresponding rim part 53Bf on the Z2 side of the relay board 53B. In the second arm parts 133R and 133L, parts 133Ra and 133La corresponding to the slits 134R and 134L engage the cut-out parts 53BdR and 53BdL of the relay board 53B, respectively.

[Configuration of Connector Socket Module 101]

Figure 13:
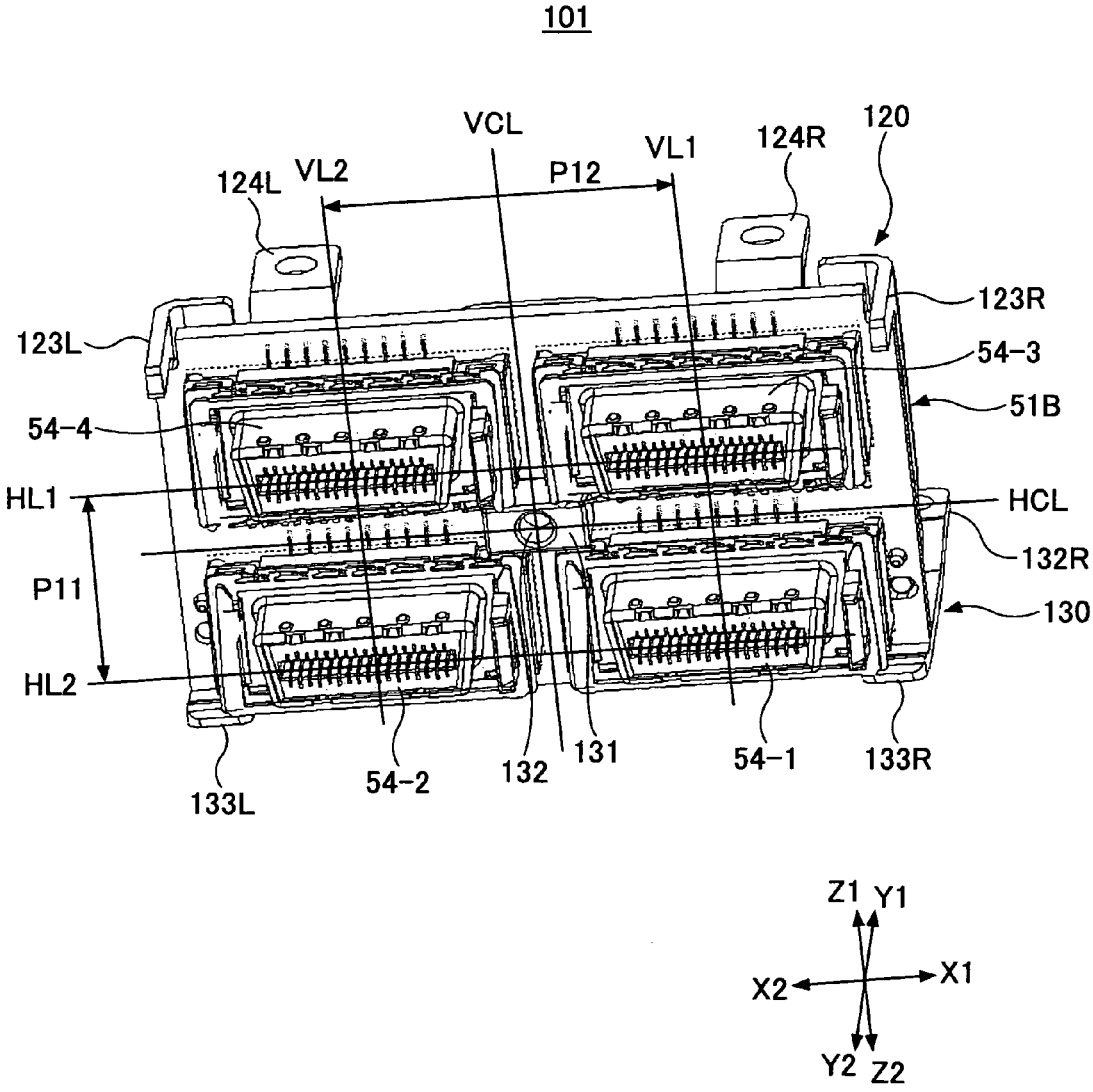
FIG. 13 is a perspective view showing a connector socket module according to the first embodiment of the present invention.

The connector socket module 101, as shown in FIGS. 13 through 15, includes the connector socket module main body 51B, the frame member 120 and the arm member 130, the frame member 120 being fixed to the connector socket module main body 51B with a screw 140 from the Y1 direction, and the arm member 130 being fixed to the connector socket module main body 51B.

<Positioning Between the Frame Member 120 and the Relay Board 53B>

As shown in FIG. 14, on the rear surface 53Bb of the relay board 53B, a center part of the relay board 53B is fixed to the fixing plated part 125 with a screw. As shown in FIG. 15, a spacer member 145 having a screw hole 146 is disposed at a through hole 53Be on the front surface 53Ba of the relay board 53B. A screw 140 with a washer 141 is inserted from the front surface 53Ba of the relay board 53B into the hole 125*a* and the through hole 53Be and is screwed into a screw hole 146 in the spacer member 145 to fix the frame member 120 to the relay board 53B. The size of the spacer member 145 is small enough so as to be disposed into the center of the four connector sockets 52-1 through 52-4 arranged in a matrix manner. Further, the spacer member 145 has substantially a cube shape with the screw hole 146 formed at its center.

As seen from FIG. 16, right and left ends on the rear surface 53Bb of the relay board 53B come into contact with the side bracket parts 122R and 122L, respectively.

As seen from FIG. 14, end parts of the protruding parts 123R and 123L are engaged with the cut-out parts 53BcR and 53BcL of the relay board 53B, respectively. The protruding parts 123R and 123L project in the Y2 direction, respectively, from corners in the X1 and X2 directions on the Z1 side of the relay board 53B.

<Positioning Between the Arm Part 130 and the Relay Board 53B>

As seen from FIG. 16, right and left ends of the rim part 53Bf on the Z2 side of the relay board 53B are engaged with the slits 134R and 134L, respectively. Further, the cut-out parts 53BdR and 53BdL of the relay board 53B are engaged with the parts 133Ra and 133La, respectively.

The first arm parts 132R and 132L project in the Y1 direction from corners on the X1 and X2 sides on the Z2 side of the relay board 53B, respectively.

Further, the second arm parts 133R and 133L project in the Y2 direction from corners on the X1 and X2 sides on the Z2 side of the relay board 53B, respectively.

[Configuration of Main Board Apparatus 70B]

As shown in FIGS. 11 and 12, the main board apparatus 70B includes a main board 150 on which, for example, a main-board-side connector 151 and a control LSI (not shown) are mounted. As shown in FIG. 11, the main-board-side connector 151 has an opening 151*a* directed in the Y2 direction, and a positioning projection 152 also projects in the Y2 direction.

Further the main board 150, having a thickness "C", includes an upper surface 150*a*, and a lower surface 150*b*, end surface parts 150*c*R and 150*c*L at right and left ends on the Y2 side, respectively, and through holes 150*e*R and 150*e*L corresponding to studs 180 described below.

[Configuration of Connector Socket Module Apparatus 100]

As shown in FIG. 10, the connector socket module apparatus 100 includes the connector socket modules 101 and the main board apparatus 70B fixed to the connector socket modules 101.

The main-board-side connector 151 is connected to the relay connector 110 by engaging the positioning projection 152 with the slit 111 from the Y2 direction. Accordingly, the main-board-side connector 151 and the relay connector 110 are arranged in the Y1-Y2 direction.

The main board 150 is supported on the supporting parts 132Rb and 132Lb of the first arm parts 132R and 132L, respectively, of the arm member 130. A screw 107 is inserted through the through hole 150*d*R (150*d*L) from an upper surface 150*a* of the main board 150 and is screwed into a receiving screw part 132Rc (132Lc) to fix the main board 150 in place to the first arm part 132R (132L). A header 107*a* of the screw 107 is disposed on the upper surface 150*a* of the main board 150.

The main board 150 is disposed higher (in the Z1 direction) than the end surface 53Bg on the Z2 side of the relay board 53B. End surface parts 150*c*R and 150*c*L of the main board 150 face to and come into contact with a rear surface 53Bb of the relay board 53B.

Because of this structure, the height of the main board 150 is included in the height of the relay board 53B. Thus, the height A2 of the connector socket module apparatus 100 is less than the height A1 of the connector socket module apparatus 80 shown in FIG. 5 by at least the thickness C of the main board 150.

[Configuration of Chassis Panel 11B]

Figure 17:
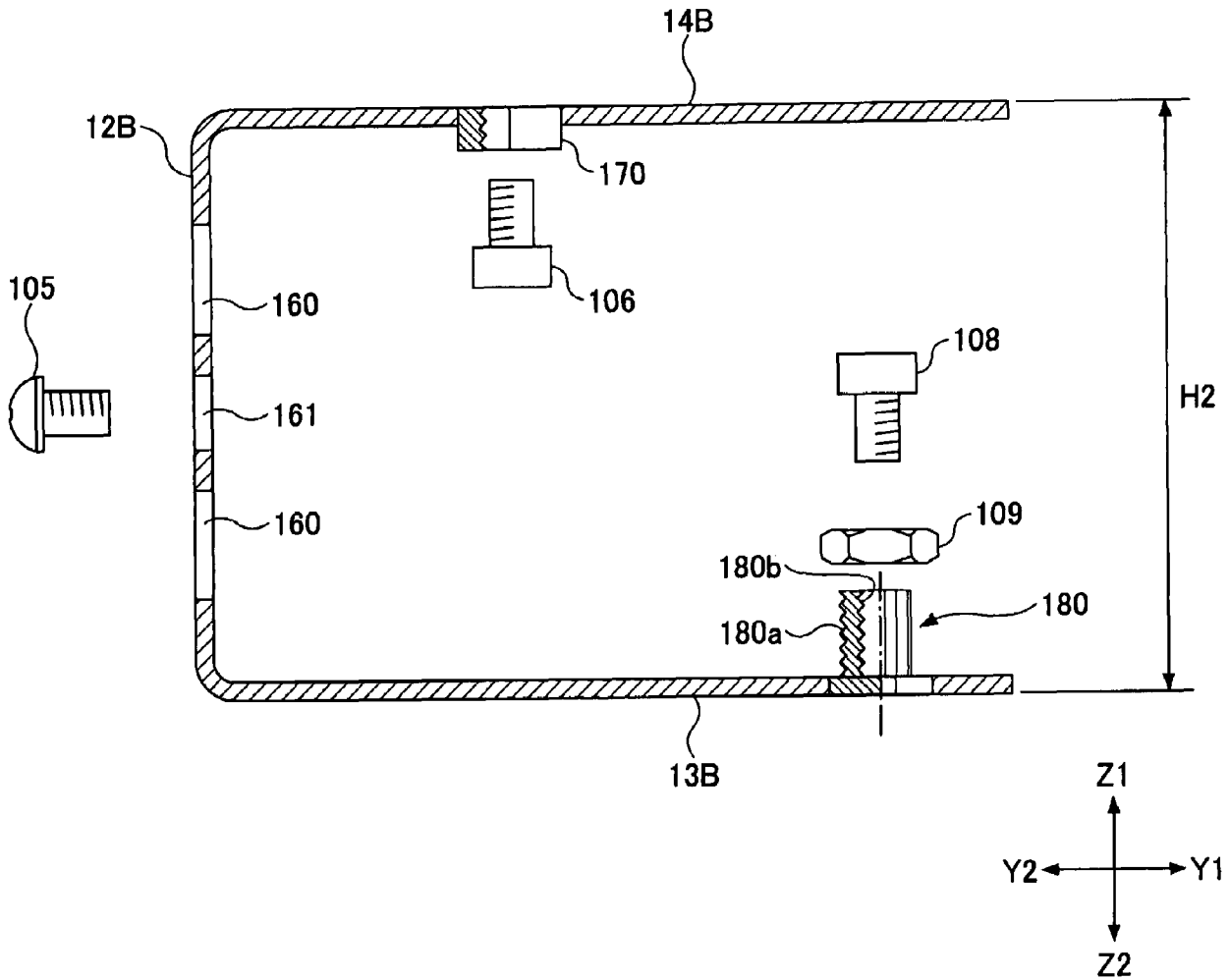
FIG. 17 is a view showing a chassis panel.

As shown in FIG. 17, the chassis panel 11B includes the front panel 12B, the bottom panel 13B, and the top panel 14B. The height H2 of the chassis panel 11B is less than the height H1 of the chassis panel 11 shown in FIG. 5.

The front panel 12B includes openings 160 through which the connector sockets 52-1 through 52-4 are projected and a hole 161 for receiving the screw 105. On a lower surface of the top panel 14B, there is a stud 170 with a screw hole. The stud 170 is formed by pressing and is fixed to the top plate 14B. The stud 170 is used with the screw 106. On an upper surface of the bottom panel 13B, there is a stud 180. The stud 180 is formed by pressing and is fixed to the bottom panel 13B. The stud 180 is projected from the upper surface of the bottom plate 13B. The stud 180 has a tube shape and includes a projecting screw part 180*a* on its outer surface and a receiving screw part 180*b* on its inter surface. The stud 180 is used with a nut 109 and a screw 108. The nut 109 is previously threaded along the projecting screw part 180*a*. The stud 180, the nut 109, and the screw 108 are used together for determining a height position P of the upper surface 150*a* of the main board 150 from the bottom panel 13B without being affected by tolerance of the thickness C of the main board 150.

[Fixing Structure Between Connector Socket Module Apparatus 100 and Chassis Panel 11B]

As shown in FIGS. 6 and 7, in a state where each header of the connector sockets 52-1 through 52-4 is projected through the corresponding opening 160 formed on the front panel 12B, the connector socket module apparatus 100 is fixed in place inside the chassis panel 11B with three screws 105, 106, and 108, the screws being separated from each other.

The screw 105 is used to fix the connector socket module 101 of the connector socket module apparatus 100 in place to the front panel 12B. The screw 106 is used to fix the connector socket module 101 in place to the top panel 14B. The screw 108 is used to fix the main board apparatus 70B of the connector socket module apparatus 100 in place to the bottom panel 13B.

As shown in an expanded view in FIG. 8, the screw 105 is inserted from the Y2 direction through the hole 161 of the front panel 12B and is screwed into the screw hole 146 of the spacer member 145, thereby fixing a center part on the Y2 side of the connector socket module 101 in place to the rear surface of the front panel 12B. More specifically, screws 140 and 105 are screwed through the through screw hole 146 of the spacer member 145 in the opposite directions from each other so as to fix a center part of the connector socket module main body 51B in place to the rear surface of the front panel 12B.

As shown in FIGS. 6 and 7, the screw 106 is inserted from the Z2 direction through the hole 124Ra (124La) of the upper bracket part 124R (124L) and is screwed into the stud 170, thereby fixing the upper bracket part 124R (124L) in place to the top panel 14B.

The screw 108 and the nut 109 adjustably fix the main board 150 in place to the stud 180.

Therefore, the connector socket module 101 of the connector socket module apparatus 100 is directly fixed in place to the Y1 side of the front panel 12B with the screw 105, is directly fixed in place to the Z2 side of the top panel 14B with the screw 106, and is fixed in place to the Z1 side of the bottom panel 13B by way of the main board 150 and the stud 180. Therefore, the connector socket module 101 is firmly fixed in place to the chassis panel 11B.

<Fixing Structure Between Main Board 150 and Stud 180>

The process of fixing the main board 150 to the stud 180 is described below. As shown in an expanded view in FIG. 9, first, the through hole 150*e*R of the main board 150 is engaged with the stud 180 so as to be supported on the nut 109. Then, when necessary, the nut 109 is turned so as to move the main board 150 in the Z1-Z2 direction until the height of the upper surface 150*a* of the main board 150 is substantially equal to P. This reference symbol P denotes a height position when height of the main-board-side connector 151 just fits the height of the relay connector 110. Then the screw 108 with a washer 108*a* is screwed into the receiving part 180*a* of the stud 180 to an end position. In this manner, the main board 150 is sandwiched between the washer 108*a* and the nut 109 and is fixed in its position so that the upper surface 150*a* is fixed in place at the desired height P without being affected by tolerance of the thickness C of the main board 150. Therefore, any undesired force will not be generated at a connecting section between the main-board-side connector 151 and the relay connector 110.

<Workings of Protruding Parts 123R and 123L and Second Arm Parts 133R and 133L>

When an operator holds a cable-side connector plug 40 (see FIG. 1) in the hand and connects the plug 40 to any of the connector sockets 52-1 through 52-4, a force in the Y1 direction is applied to the connector socket.

In this case, since the connector socket module 100 is fixed in place to the front panel 12B with screws at only the one position at the center of the relay board 53B, when the cable-side connector plug 40 is connected to the server 10B, the above-mentioned force is applied as a torque around an axis line VCL passing through the center of the relay board 53B where the screw is tightened and a torque around an axis line HCL passing through the center of the relay board 53B where the screw is tightened (see FIG. 16).

However, as shown in FIGS. 6 and 7, headers of the protruding parts 123R and 123L come into contact with parts on a rear surface on the Z1 side of the front panel 12B and headers of the second arm part 133R and 133L come into contact with parts on a rear surface on the Z2 side of the front panel 12B.

Because of this structure, since displacement due to the torque around the axis line VCL is received and prevented at parts where headers of the protruding part 123R and the second arm part 133R come into contact with the X1 side of the rear surface of the front panel 12B or parts where headers of the protruding part 123L and the second arm part 133L come into contact with the X2 side of the rear surface of the front panel 12B, and the torque around the axis line HCL is received and prevented by parts where headers of the protruding parts 123R and 123L come into contact with the Z1 side of the rear surface of the front panel 12B or parts where headers of the second arm parts 133R and 133L come into contact with the Z2 side of the rear surface of the front panel 12B, jolting and jouncing are prevented. As a result, an operation to connect the cable-side connector plug 40 to the server 10 (see FIG. 1) can be carried out without feeling uncomfortable.

It should be noted that the above described structure that the end surface parts 150*c*R and 150*c*L of the main board 150 fixed to the bottom panel 13B with stud 180 come into contact with the rear surface 53Bb of the relay panel 53B also receives and prevents the displacement due to the torque around the axis line VCL and a counterclockwise torque around the axis line HCL applied to the relay board 53B.

Example 2

Figure 18:
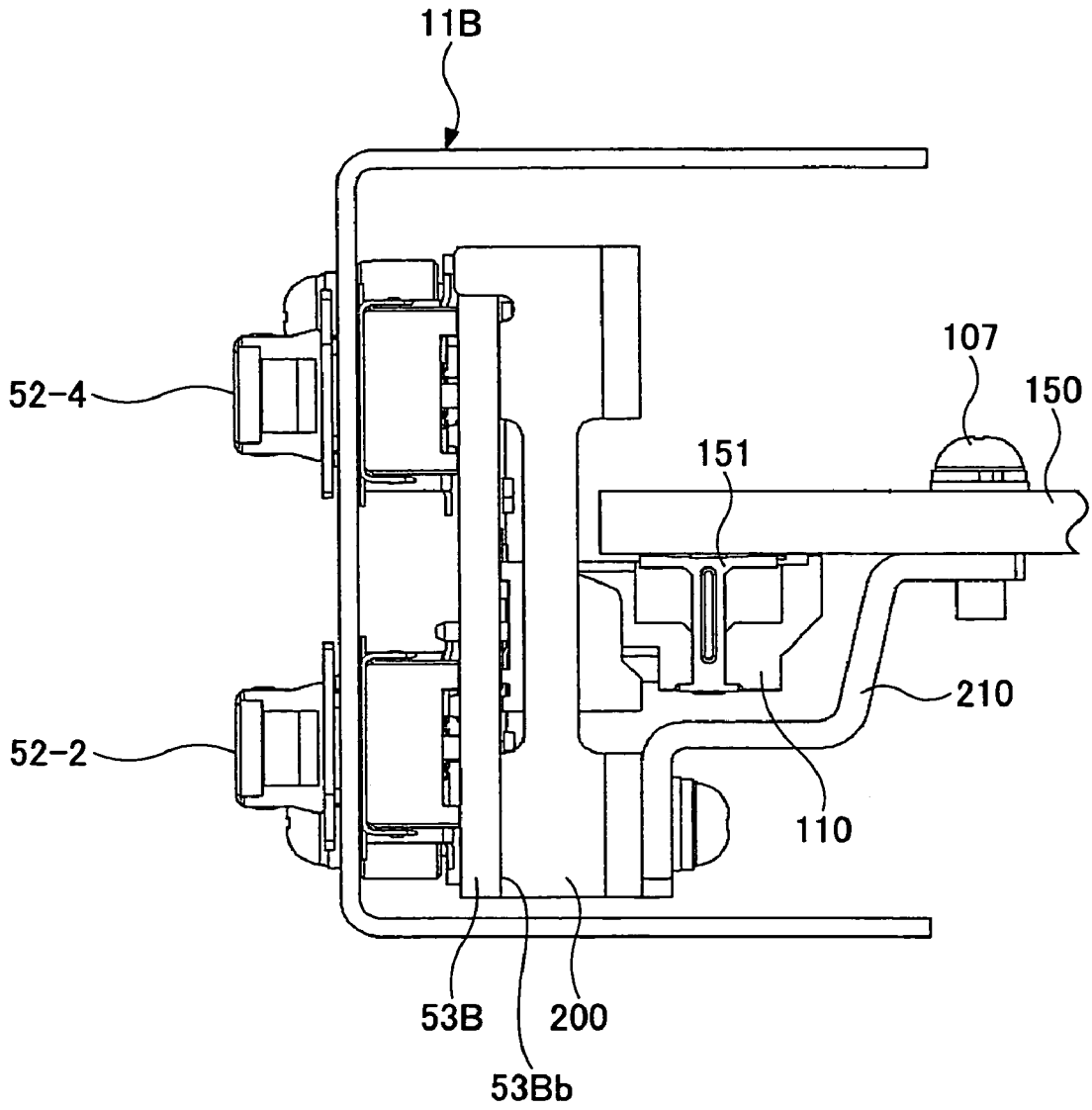
FIG. 18 is a cut-open side view of a connector socket module apparatus according to a second embodiment of the present invention.

FIG. 18 is a cut-open side view showing a configuration of a connector socket module apparatus according to a second embodiment of the present invention. The configuration of a connector socket module according to the second embodiment of the present invention is different from that of the first embodiment in that the main-board-side connector 151 is provided on the bottom surface of the main board 150 and a frame 200 and an arm member 210 are provided as main board supporting units. The other elements of the connector socket modules apparatus in the second embodiment are the same or similar to those in the first embodiment. Therefore, the same reference numerals are used to describes the same elements used in the first embodiment, and the description of the elements is omitted.

Figure 19A:
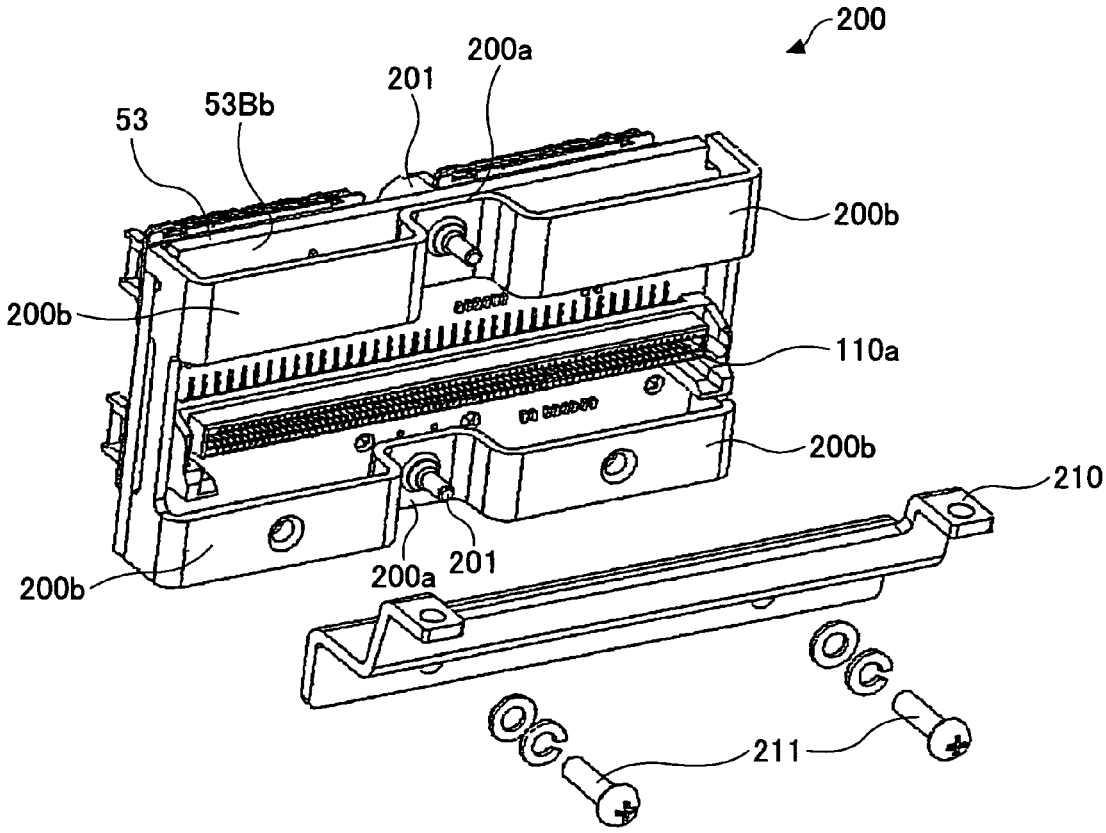
FIG. 19A is a perspective view showing a connector socket module according to the second embodiment of the present invention.
Figure 19B:
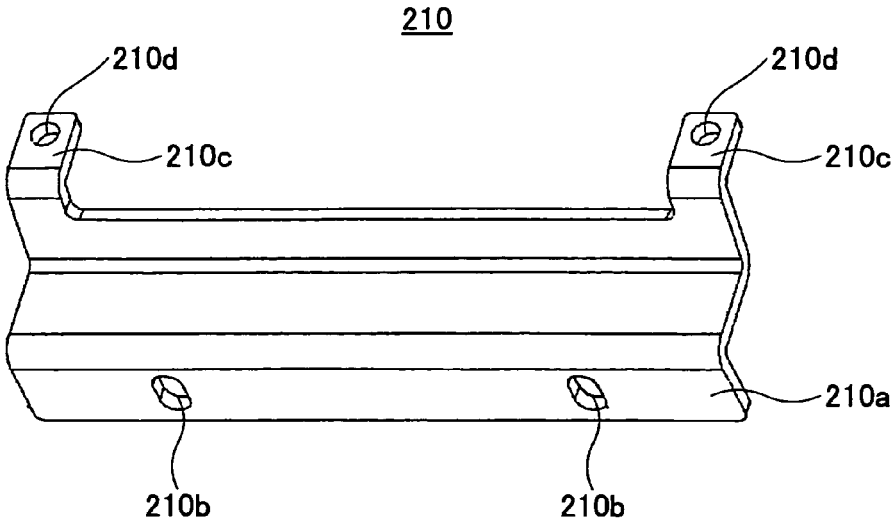
FIG. 19B is a perspective view of a arm member.

FIGS. 19A and 19B are perspective views of a connector socket module according to the second embodiment of the present invention. FIGS. 20A through 20D are views of the connector socket module according to the second embodiment of the present invention.

As shown in FIG. 19A, the frame 200 includes upper and lower parts, each part including a concave part 200*a* and two convex parts 200*b*. The concave part 200*a* is in contact with the rear surface 53Bb of the relay board 53B. The convex parts 200*b* are provided one on either side of the concave part 200*a* and project so as to provide a space between each of the projected convex parts 200*b* and the rear surface 53Bb of the relay board 53B. Each of the upper and lower concave parts 200*a* includes a screw hole, and each of the lower convex parts 200*b* also includes a screw hole.

As shown in FIG. 19A, the frame 200 is fixed to the rear surface 53B of the relay board 53B with screws 201 screwed through the screw holes of the upper and lower concave parts 200*a*. Namely, the frame 200 is fixed to the relay board 53B with two screws.

As shown in FIG. 19B, the arm member 210 includes a base part 210*a* and a pair of arm parts 210*c*. The base part 210*a* includes a pair of vertically elongated openings 210*b* so as to adjust the height of the arm member 210 when the arm member 210 is fixed to the frame 200 with screws. The pair of arm parts 210*c* is provided at each end in the width direction of the arm member 210 when viewed from above to support the main board 150. Each arm part 210*c* includes an opening 210*d* for fixing the arm member 210 to the main board 150 with a screw.

Figure 20A:
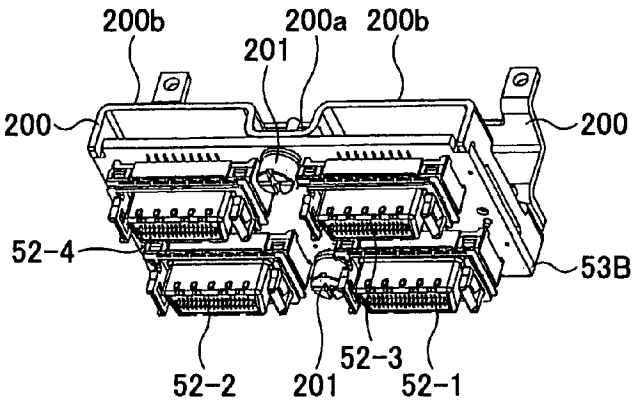
FIGS. 20A through 20D are views showing the connector socket module.
Figure 20B:
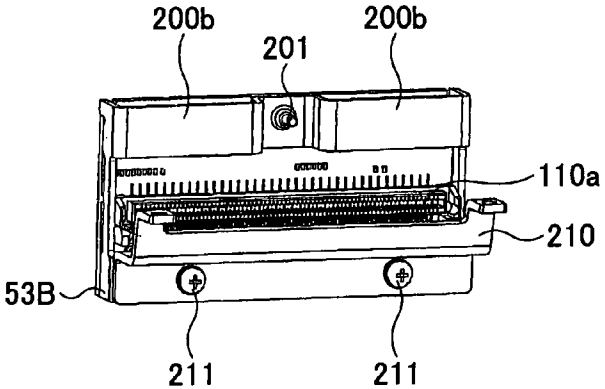
Figure 20C:
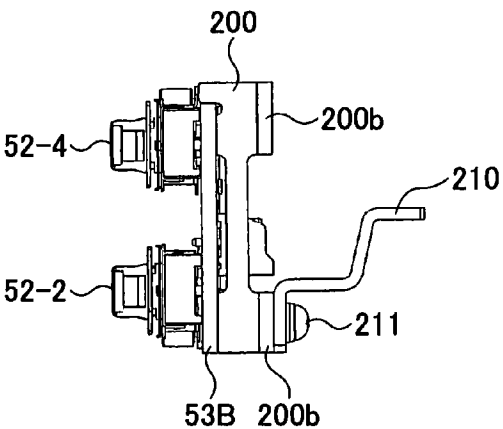

As seen from FIG. 19A, the arm member 210 is fixed to the frame 200 with screws 211, each screw 211 being inserted into both the corresponding screw hole of the convex portion 200*b* and the corresponding opening 210*b* aligned with the screw hole. FIGS. 20A through 20C show where the arm member 210 is fixed to the frame 200.

Figure 20D:
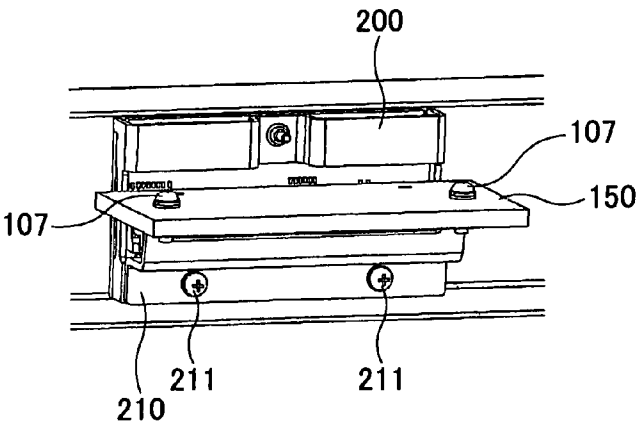

Further, as shown in FIG. 18 the arm member 210 is fixed to the main board 150 with screws 107 and extends downward from the vicinity of the fixing part so as not to contact the main-board-side connector 151 and the relay connector 110. FIG. 20D shows where the arm member 210 is fixed to the main board 150 when viewed obliquely from the upper rear side.

As described above, when the main board 150 is fixed to the relay board 53B with the frame 200 and the arm member 210, the relay connector 110 is located at a height close to the middle of the relay board 53B in the height direction. Therefore, the height below the relay board 53B in this second embodiment is lower than that in the first embodiment. This is because, when the main board 150 is disposed at a lower level of the relay board 53B as described in the first embodiment, it is necessary to secure a space under the main board 150 for providing the arm member 130 and for fixing the main board 150 to the chassis 11B with the screw 108. On the other hand, when the main board 150 is displaced at a center position of the relay board 53B as described in the second embodiment, it is not necessary to secure the space for providing the arm member 130 and for fixing with the screw 108.

Further, since the position where the arm member 130 in the second embodiment is disposed higher than that in the first embodiment, more space is provided in the vicinity of the lower part of the rear surface 53Bb of the relay board 53B. Because of this feature, as shown in FIGS. 19A and 20A, two separate screws 201 are used in upper and lower parts to fix the connector socket module to the chassis panel 11B, thereby reinforcing the fixing of the connector socket module to the chassis panel 11B.

Although exemplary socket connector modules and electronic devices using the same according to the embodiments of the present invention are described above, the present invention is not limited to those embodiments disclosed above and variations and modifications may be made without departing from the scope of the present invention.

The present application is based on and claims the benefit of priority of Japanese Patent Application Nos. 2007-088778, filed on Mar. 29, 2007 and 2007-208421, filed on Aug. 9, 2007, the entire contents of which are hereby incorporated by reference.

What is claimed is:

1. A connector socket module comprising:

a plurality of connector sockets;

a relay board having a pattern of wiring electrically connected to the connector sockets, and being provided on a front side of the relay board;

a relay connector provided on a rear side of the relay board and electrically connected to the connector sockets through the pattern of wiring;

a frame member fixed to the rear side of the relay board; and a main board supporting unit extending from the rear side of the relay board and supporting a main board at a prescribed height between an upper end and a lower end of the relay board, the main board having a main-board-side connector connected to the relay connector and the main board extending from the rear side of the relay board, wherein an arm member is provided as the main board supporting unit, the arm member including a first arm part engaged with a lower side of the relay board and projected from the rear side of the relay board and supporting the main board; and the main board is supported on the first arm part and fixed to the first arm part.

2. The connector socket module according to claim 1, wherein the first arm part includes a supporting part at a top end of the first arm part and supports the main board on the top end of the first arm part; and the supporting part is located higher than a base end of the first arm part.

3. The connector socket module according to claim 1, wherein the relay board includes a cut-out part on a lower side of the relay board, and the arm member engages the cut-out part.

4. The connector socket module according to claim 1, wherein the relay connector has a connecting part facing the back side of relay board.

5. The connector socket module according to claim 1, wherein the arm member further includes a second arm part extending to the front side of the relay board and coming into contact with the chassis panel.

6. An electronic device comprising:

a connector socket module according to claim 1;

the main board supported by the main board supporting unit; and a chassis panel housing the connector socket module and the main board.

7. The connector socket module according to claim 1, wherein the frame member includes a main body part for supporting a main body of the connector socket module, a protruding part extending through a corner of the relay board to the front side of the relay board and coming into contact with a chassis panel.

8. The connector socket module according to claim 7, wherein the frame member further includes a bracket part to be fixed to the chassis panel.

9. The connector socket module according to claim 1, wherein the main-board-side connector is disposed below the main board;

the frame member includes a concave part contact the rear side of the relay board, and a projecting convex part providing a space between the rear side of the relay board and the frame member; and an arm member is provided as the main board supporting member, the arm member being fixed to the frame member, supporting the main board from the lower side of the main board, the arm member being disposed so as not to come into contact with the main-board-side connector and the relay connector connected to the main-board-side connector.

10. The connector socket module according to claim 9, wherein the arm member includes a pair of arm parts supporting the main board, the arm parts being provided one on each end side of the arm member in the width direction when viewed from above.

11. A connector socket module comprising:

a plurality of connector sockets;

a relay board having a pattern of wiring electrically connected to the connector sockets provided on a front side of the relay board;

a relay connector provided on a rear side of the relay board and electrically connected to the connector sockets through the pattern of wiring;

a main board supporting unit extending from the rear side of the relay board and supporting a main board at a prescribed height between an upper end and a lower end of the relay board, the main board having a main-board-side connector connected to the relay connector; and a frame member including the main body part supporting a main body of the connector socket module, and a protruding body part extending through a corner of the relay board to the front side of the relay board and coming into contact with a chassis panel.

12. The connector socket module according to claim 11, wherein the frame member further includes a bracket part to be fixed to the chassis panel.

13. The connector socket module according to claim 11, wherein the first arm part includes a supporting part at a top end of the first arm part and supports the main board on the top end of the first arm part; and the supporting part is located higher than a base end of the first arm part.

14. The connector socket module according to claim 11, wherein the relay connector has a connecting part facing the back side of relay board.

15. The connector socket module according to claim 11, wherein the arm member includes a pair of arm parts supporting the main board, the arm parts being provided one on each end side of the arm member in the width direction when viewed from above.

16. An electronic device comprising:

a connector socket module according to claim 11;

the main board supported by the main board supporting unit; and a chassis panel housing the connector socket module and the main board.

17. The connector socket module according to claim 11, wherein an arm member is provided as the main board supporting unit, the arm member including a first arm part engaged with a lower side of the relay board and projected from the rear side of the relay board and supporting the main board; and the main board is supported on the first arm part and fixed to the first arm part.

18. The connector socket module according to claim 17, wherein the relay board includes a cut-out part on a lower side of the relay board, and the arm member engages the cut-out part.

19. The connector socket module according to claim 17, wherein the arm member further includes a second arm part extending to the front side of the relay board and coming into contact with the chassis panel.

20. A connector socket module comprising:

a plurality of connector sockets;

a relay board having a pattern of wiring electrically connected to the connector sockets, provided on a front side of the relay board;

a relay connector provided on a rear side of the relay board and electrically connected to the connector sockets through the pattern of wiring; and a main board supporting unit extending from the rear side of the relay board and supporting a main board at a prescribed height between an upper end and a lower end of the relay board, the main board having a main-board-side connector connected to the relay connector; and an arm member is provided as the main board supporting unit, the arm member including a first arm part engaged with a lower side of the relay board and projected from the rear side of the relay board and supporting the main board;

wherein the main board is supported on the first arm part and the fixed to the arm part, and wherein the arm member further includes a second arm part extending to the front side of the relay board and coming into contact with the chassis panel.

21. The connector socket module according to claim 20, wherein the first arm part includes a supporting part at a top end of the first arm part and supports the main board on the top end of the first arm part; and the supporting part is located higher than a base end of the first arm part.

22. The connector socket module according to claim 20, wherein the relay board includes a cut-out part on a lower side of the relay board, and the arm member engages the cut-out part.

23. The connector socket module according to claim 20, wherein the relay connector has a connecting part facing the rear side of relay board.

24. The connector socket module according to claim 20, wherein the arm member includes a pair of arm parts supporting the main board, the arm parts being provided one on each end side of the arm member in the width direction when viewed from above.

25. An electronic device comprising:

a connector socket module according to claim 20;

the main board supported by the main board supporting unit; and a chassis panel housing the connector socket module and the main board.

26. The connector socket module according to claim 20 further comprising:

a frame member including the main body part supporting a main body of the connector socket module, a protruding body part extending through a corner of the relay board to the front side of the relay board and coming into contact with a chassis panel.

27. The connector socket module according to claim 26, wherein the frame member further includes a bracket part to be fixed to the chassis panel.

* * * * *

UNITED STATES PATENT AND TRADEMARK OFFICE

CERTIFICATE OF CORRECTION

PATENT NO. : 7,607,939 B2
APPLICATION NO. : 12/068356
DATED : October 27, 2009
INVENTOR(S) : Satoshi Moriyama et al.

It is certified that error appears in the above-identified patent and that said Letters Patent is hereby corrected as shown below:

Column 13, Line 50, change "the" to --a--.

Column 13, Line 59, after "part" delete "for".

Column 14, Line 5, change "contact" to --contacting--.

Column 14, Line 35, change "the main body" to --a main body--.

Column 14, Line 37, before "part" delete "body".

Column 14, Line 50, change "back" to --rear--.

Column 15, Line 15, change "sockets," to --sockets--.

Column 15, Line 29, change "board;" to --board,--.

Column 15, Line 31, change "and the fixed to the arm part, and" to --and fixed to the first arm part, and--.

Column 16, Line 23, after "claim 20" insert --,--.

Column 16, Line 26, before "main body" change "the" to --a--.

Column 16, Line 28, before "part" delete "body".

Signed and Sealed this

Twenty-sixth Day of January, 2010

David J. Kappos

David J. Kappos
*Director of the United States Patent and Trademark Office*